United States Patent [19]

Frink et al.

[11] 4,049,936

[45] Sept. 20, 1977

[54] QUICK-ACTING MOVABLE OPERATING-COLUMN TRIPPING DEVICE

[75] Inventors: Russell E. Frink, Pittsburgh; Stanislaw A. Milianowicz, Monroeville, both of Pa.

[73] Assignee: Westinghouse Electric Corporation, Pittsburgh, Pa.

[21] Appl. No.: 559,465

[22] Filed: Mar. 18, 1975

Related U.S. Application Data

[62] Division of Ser. No. 468,332, May 8, 1974.

[51] Int. Cl.[2] ..... H01H 33/12

[52] U.S. Cl. ..... 200/146 R; 200/153 SC

[58] Field of Search ..... 200/146 R, 153 SC

[56] References Cited

U.S. PATENT DOCUMENTS

| | | | |
|---|---|---|---|
| 3,154,656 | 10/1964 | Gussow et al. | 200/146 R |
| 3,689,721 | 9/1972 | McGuffie | 200/153 SC |
| 3,769,477 | 10/1973 | Chabala et al. | 200/146 R |
| 3,773,995 | 11/1973 | Davies | 200/153 SC |

*Primary Examiner*—Robert S. Macon

*Attorney, Agent, or Firm*—W. R. Crout

[57] ABSTRACT

A quick-acting movable-column tripping device is provided as an optional feature of either circuit-interrupters, supported by upstanding insulating column structures, or, alternatively, in connection with circuit-interrupters having a serially-related disconnecting switchblade, providing a visible open-circuit gap, so that a minimum of time is utilized in a tripping operation of the circuit-interrupter. Otherwise, there would be a considerably-delayed action caused by the normal, or inherent lost-motion provided in the loose linkages, which normally are used to effect operative movement of the movable relatively massive supporting column structure.

The quick-acting, accelerating tripping device of the present invention provides relative fast motion between the upstanding rotatable supporting column structure and a base-spindle device, the latter of which is operatively mechanically linked to the motor-operated mechanism, for example, of the switch structure, which may be relatively slow in operation.

Relative fast rotation, for example, between the upstanding rotatable supporting column structure and the lower base-spindle structure is provided by a suitable bearing support provided therebetween, together with a latched biasing structure, which when unlatched, or released, will permit a slight relative degree of rotation, say, for example, 8 degrees of rotation, between the upstanding, operating, supporting column structure and the driving base-spindle structure, preferably release occurring by means of a suitable electrically-actuated solenoid device for each pole-unit, which, through suitable energization in synchronism with the motor for operating the driving linkage, will effect unlatching or release of the spring-assembly, and thereby permitting a slight resulting relative motion, say of the order of 8 degrees, for example, to occur between the upstanding, rotatable operating support column and the more relatively slowly moving rotatable base-spindle structure, the latter being mechanically linked to the motor-operator of the interrupter.

Relatching may occur, thereby effecting a resetting of the latch structure at the end of the tripping opening operation of the breaker, so that the spring assembly will be recharged and the latches reset to result in a unitary structure, operable to effect the closing operation of the associated circuit-interrupter as a unit, or if a serially-related disconnecting switchblade structure is used, closing motion of the latter.

12 Claims, 58 Drawing Figures

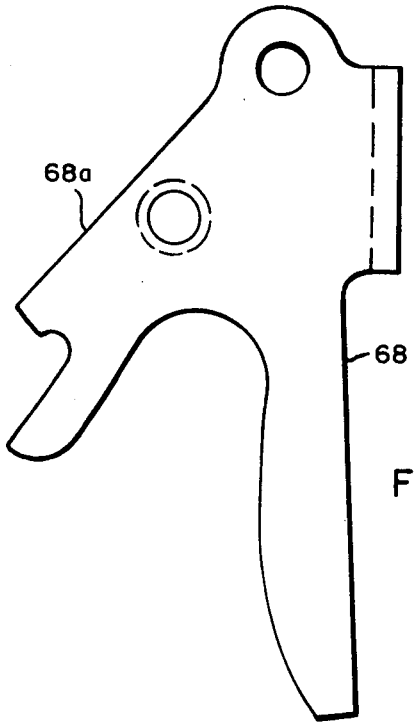
FIG. 19
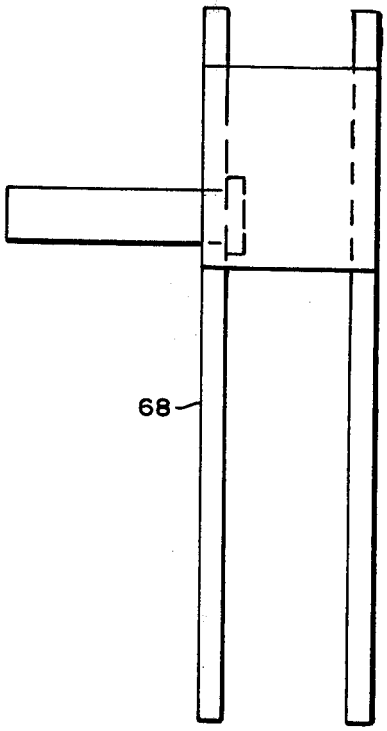
FIG. 20
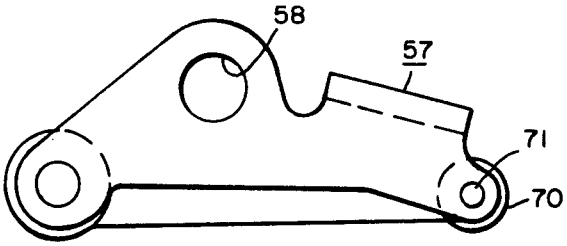
FIG. 21
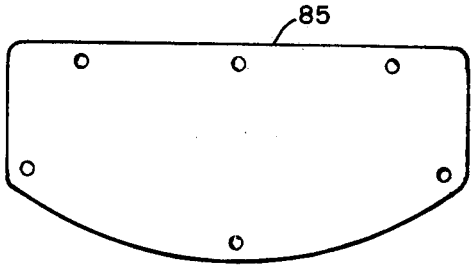
FIG. 23
FIG. 22
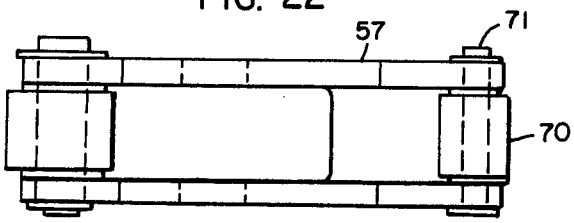

ENTIRE ASSEMBLAGE FULLY OPEN AND LINKAGE RESET

CONTACT OPEN-CIRCUIT POSITION WITH CLOSING SPRING DISCHARGED AND LATCH ASSEMBLY RESET

READY TO CLOSE

CONTACT OPEN-CIRCUIT POSITION WITH CLOSING SPRINGS CHARGED AND READY TO TRIGGER CONTACTS TO CLOSE CIRCUIT POSITION HOOK LINKS LATCHED

ENTIRE ASSEMBLAGE CLOSED AND READY TO TRIP

CONTACT CLOSED-CIRCUIT POSITION-HOOK LINKS UNLATCHED-BREAKER READY FOR TRIPPING TO CONTACT OPEN POSITION

TRIPPED
NOT
RESET

CONTACTS TRIPPED OPEN

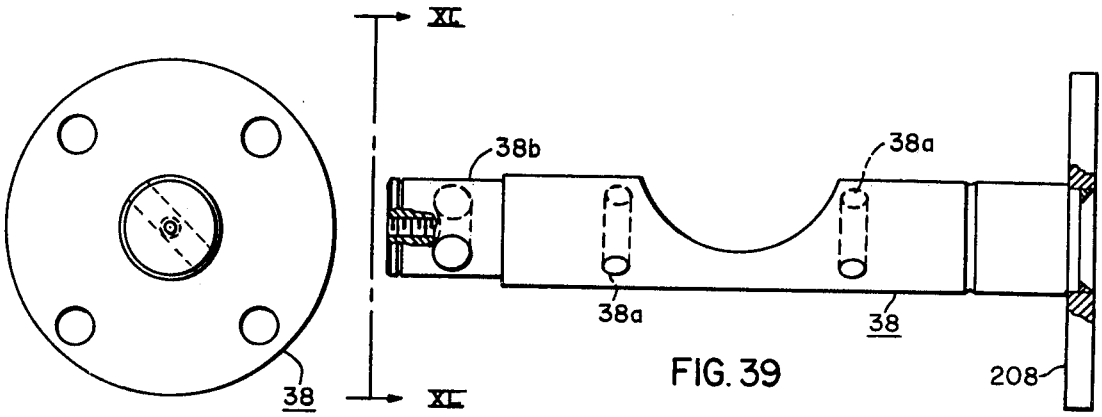
FIG. 39
FIG. 40
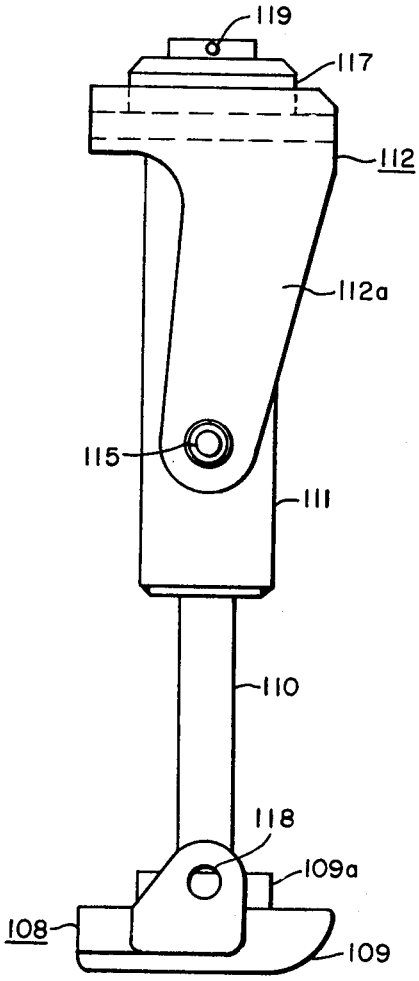
FIG. 41
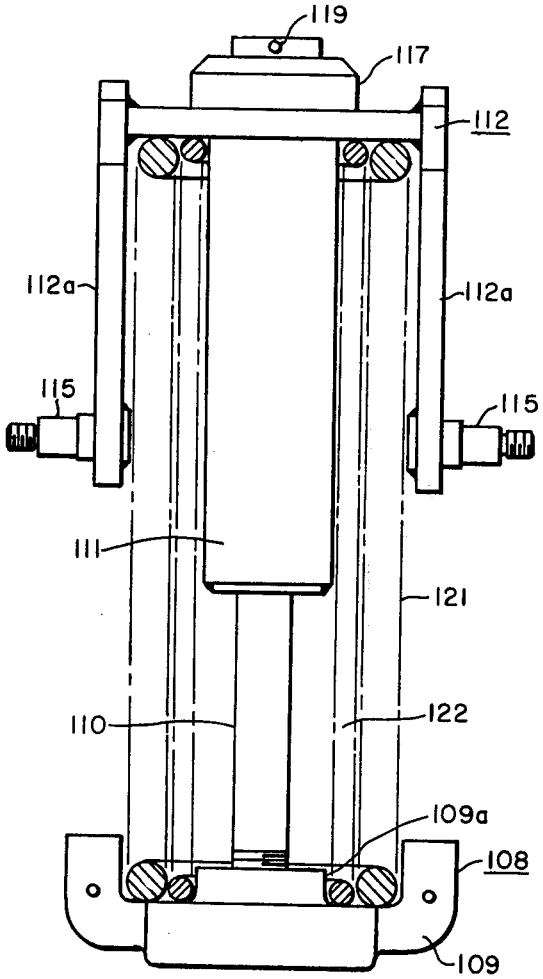
FIG. 42

QUICK-ACTING MOVABLE OPERATING-COLUMN TRIPPING DEVICE

CROSS-REFERENCES TO RELATED APPLICATIONS

This is a division of application Ser. No. 468,332 filed May 8, 1974.

Reference may be had to the following patent applications: U.S. patent application filed May 14, 1974, Ser. No. 469,931 by Russell E. Frink and Stanislaw A. Milianowicz; U.S. patent application filed May 13, 1974, Ser. No. 469,586, now U.S. Pat. No. 4,000,387 issued Dec. 28, 1976 to Stanislaw A. Milianowicz; U.S. patent application filed May 14, 1974, Ser. No. 469,932, now U.S. Pat. No. 3,943,314 issued Mar. 9, 1976 to Russell E. Frink; U.S. patent application filed May 3, 1974, Ser. No. 466,745, now U.S. Pat. No. 3,932,715 issued Jan. 13, 1976 to Steren Swencki and Stanislaw A. Milianowicz; U.S. patent application filed July 31, 1967, Ser. No. 657,122, now U.S. Pat. No. 3,588,407 issued June 29, 1971 to Russel E. Frink, et al. by all of the foregoing patent applications being assigned to the assignee of the instant patent application.

BACKGROUND OF THE INVENTION

It has been common in the prior art to utilize rotating, supporting, insulating column structures to effect the operation of load-break disconnecting switch structures. For example, note U.S. Pat. Nos. 2,911,506 — Owens, 2,853,584 — Upton, Jr., 2,769,063 — Lingal, and 2,737,556 —MacNeill et al.

As far as we are aware, in prior-art devices separate insulator columns were required for both operation and tripping. An example of such a device is set forth in U.S. Pat. No. 3,116,391 — Lindell et al.

SUMMARY OF THE INVENTION

In accordance with the present invention, there is provided an upstanding movable supporting insulating column structure, which has at the base portion thereof an interposed tripping accelerating device between the aforesaid upstanding, movable operating supporting column structure and a rotatable supporting turntable, the latter being mechanically linked to the usually-provided linkage extending to a motor-operated mechanism, for example. This interposed accelerating device comprises a spring-charged, latched device, which may be tripped in synchronism with the energization of the motor-operated linkage. Due to its instant reaction, relative tripping motion instantly occurs between the upstanding, supporting insulating column and the lower rotatable initiating spindle device, the latter being mechanically linked to the linkage structure extending to the motor-operated mechanism, usually provided and somewhat inherently slow in operation.

This interposed spring-charged accelerating device may be utilized as an optional feature, or may, if desired, be added to existing circuit-interrupting devices in the field with little trouble.

In more detail, the accelerating, spring-charged tripping device comprises a suitable biasing means, such as a spring, for example, which may be either a compression spring or a tension spring charged in an energized state, and latched. To effect a very quick relative motion, such as a rotating motion, for example, between the upstanding, rotatable supporting column structure and the base spindle structure linked to the motor-operated mechanism, a latch is released by the energization of a suitable releasing device, such as an electrically-operated tripping solenoid. Immediately, there will occur relative rotative motion between the upstanding supporting column structure and the lower base spindle structure, the latter, as mentioned previously, being linked to the motor-operated mechanism, for example.

Following the slight quick-acting relative motion, relative motion between the two parts ceases, and thereafter, during the opening operation, the two parts move together as a single unitary structure. At the end of the opening operation of the linkage, a resetting of the latch structure occurs, together with a recharging of the spring assembly. During the closing operation, reverse rotative movement of the column structure occurs, and in the closing reverse rotative travel, the two parts are latched together and move together as a single unitary device.

BRIEF DESCRITPION OF THE DRAWINGS

FIG. 1 is an end elevational view of the three poles of a three-phase circuit-interrupting assemblage, illustrating each of the pole-units in the electrically-closed-circuit position, and showing the mechanically-interconnecting linkage extending between the three pole-units and the motor-operated mechanism associated therewith, the linkage structure being likewise illustrated in the closed-circuit position;

Figure 3:
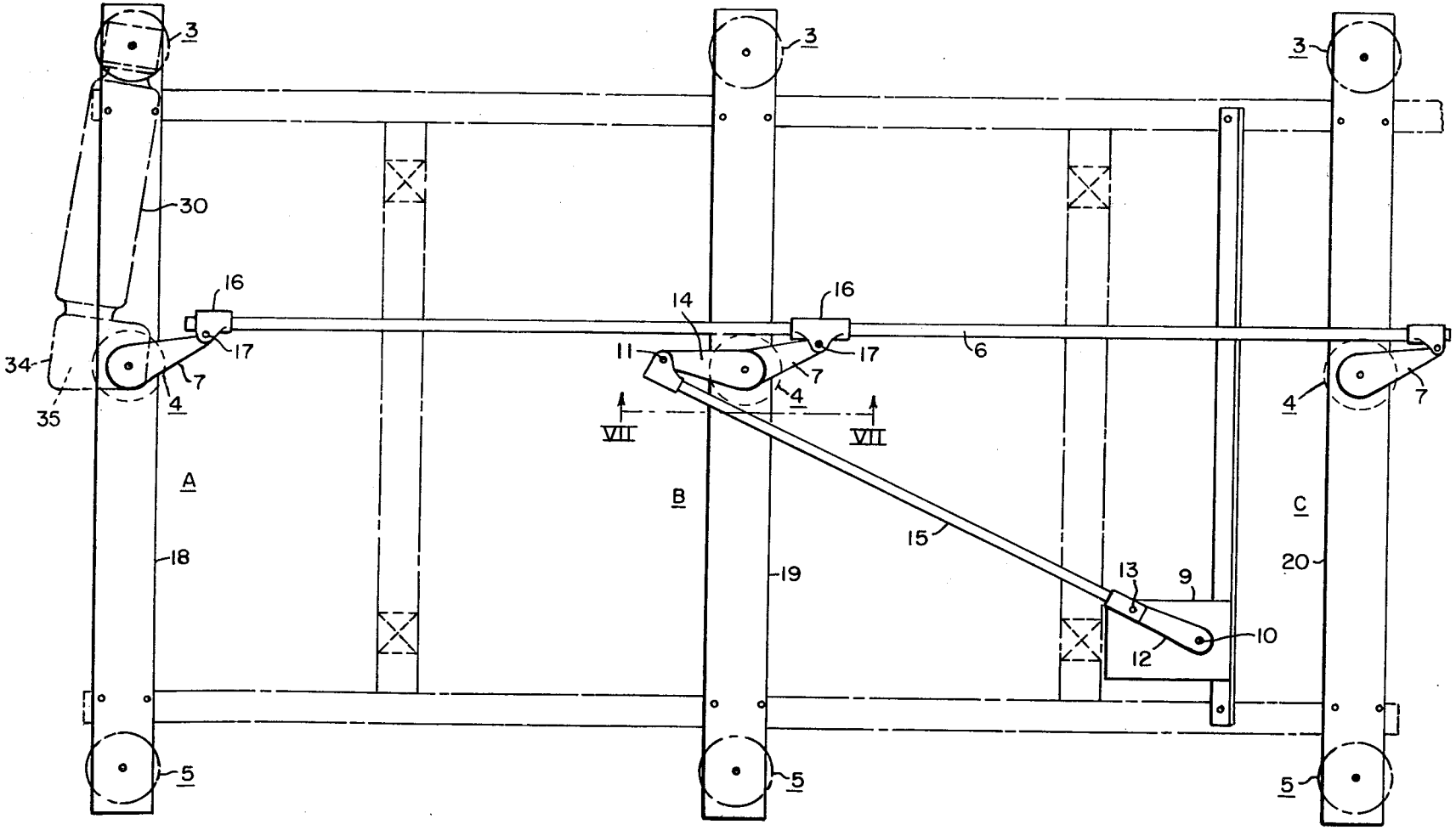
FIG. 3 is a top plan view of the interconnecting linkage for operating the three pole-units in unison, with some of the column structures being diagrammatically illustrated, and the lower interrupting unit also being diagrammatically illustrated, the entire device being shown in the closed-circuit position.
Figure 4:
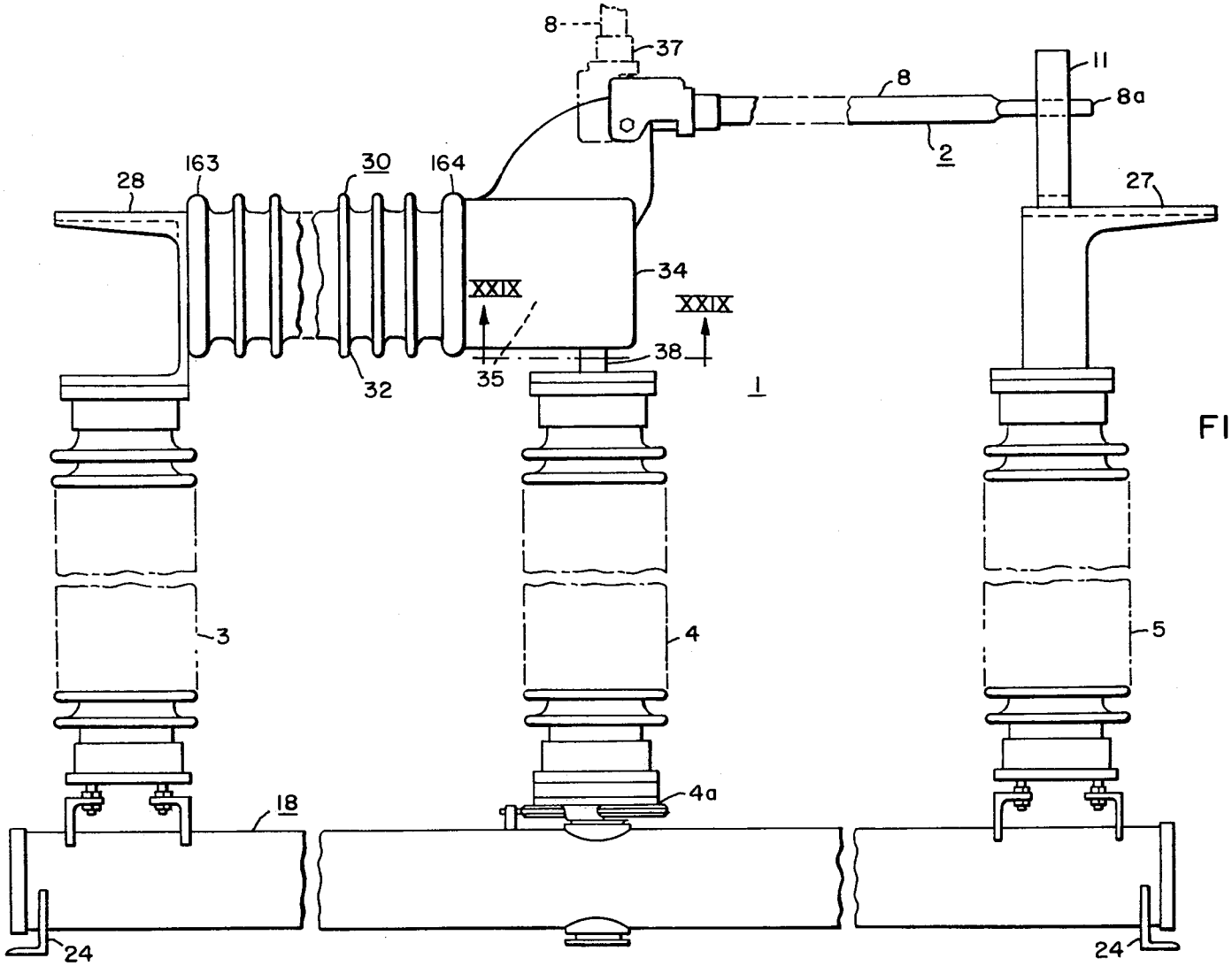
FIG. 4 is a side-elevational view of one pole-unit of the three-phase circuit-interrupting assemblage of FIGS. 1-3, having a serially-related disconnecting switchblade, but illustrating a construction which does not incorporate the optional accelerating tripping device of the present invention, the device being shown in the closed-circuit position.
Figure 58:
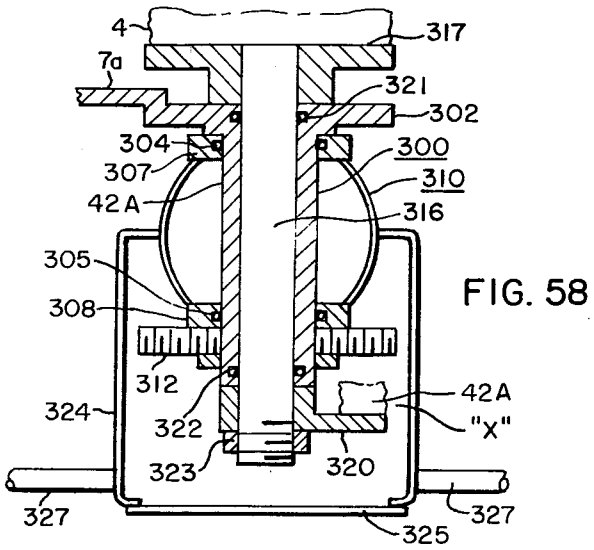
Figure 56:
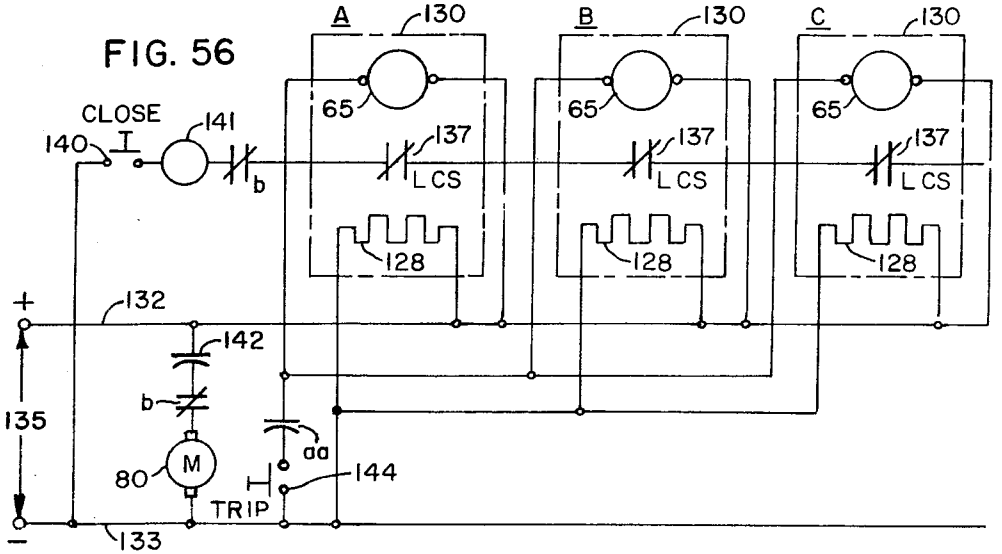
Figure 5:
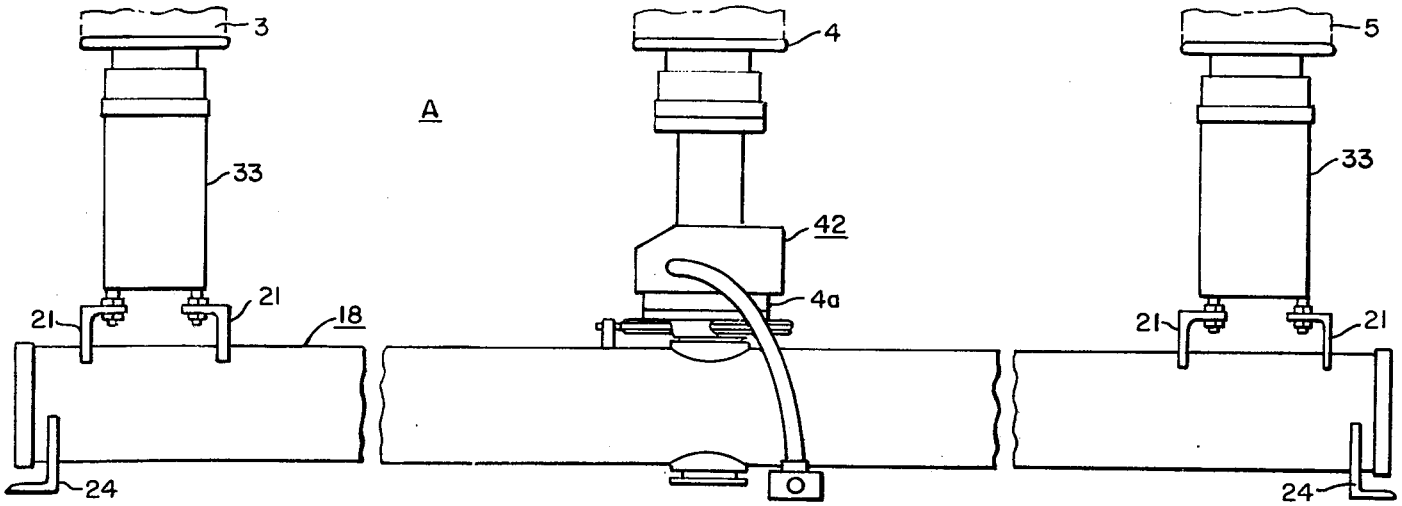
Figure 6:
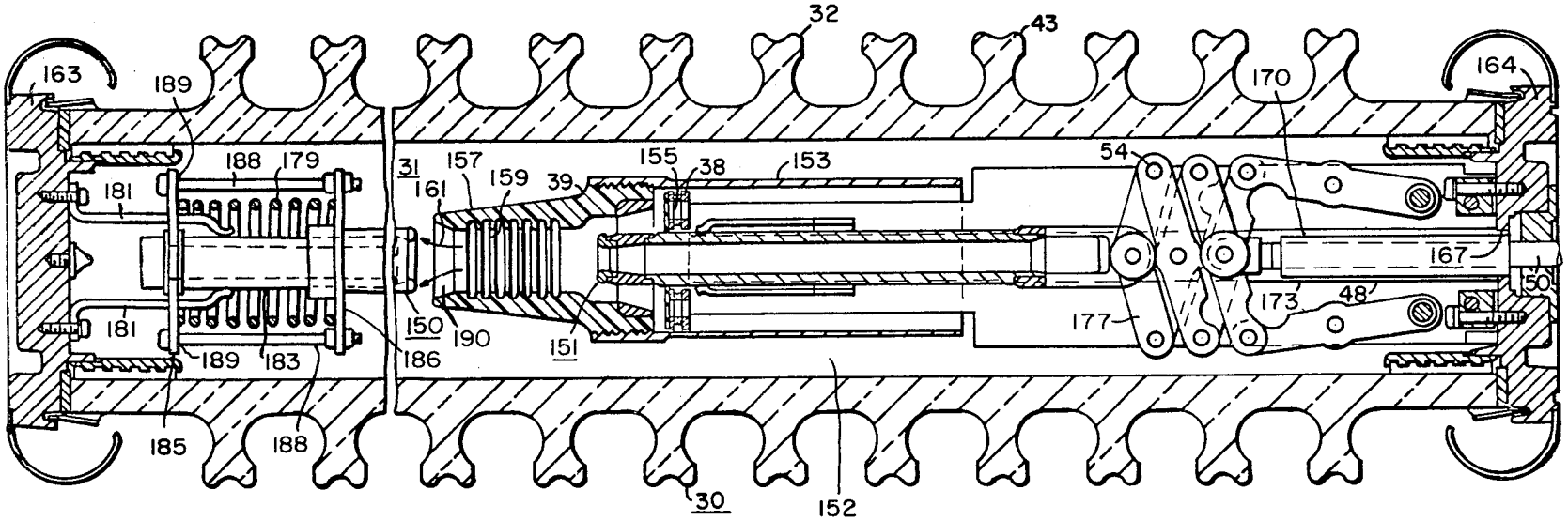
Figure 8:
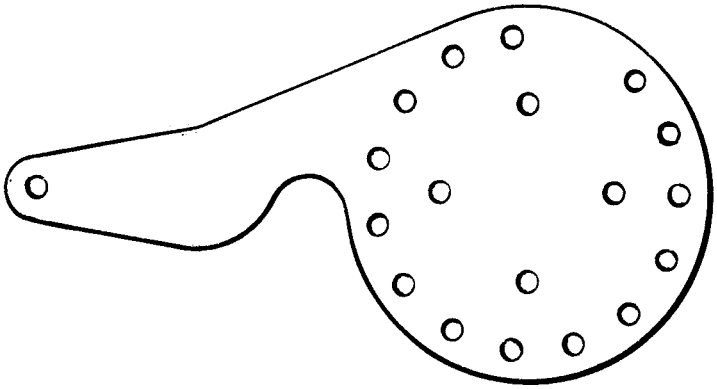
Figure 9:
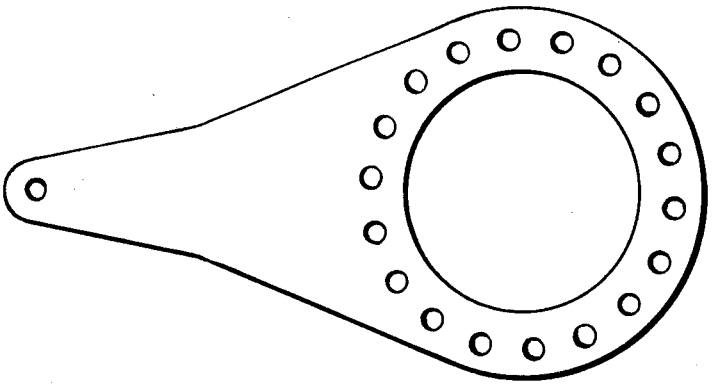
Figure 7:
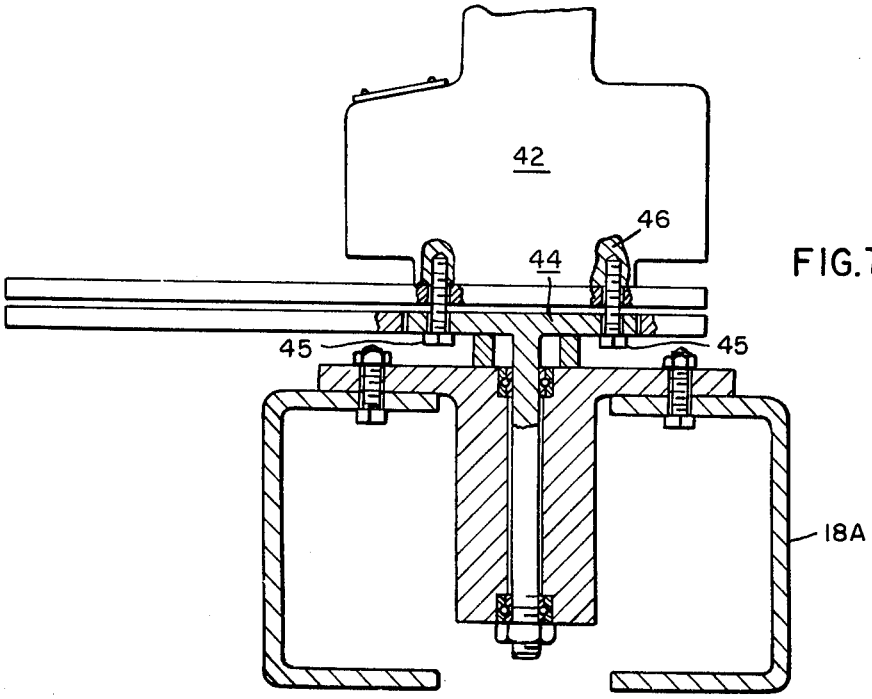
Figure 10:
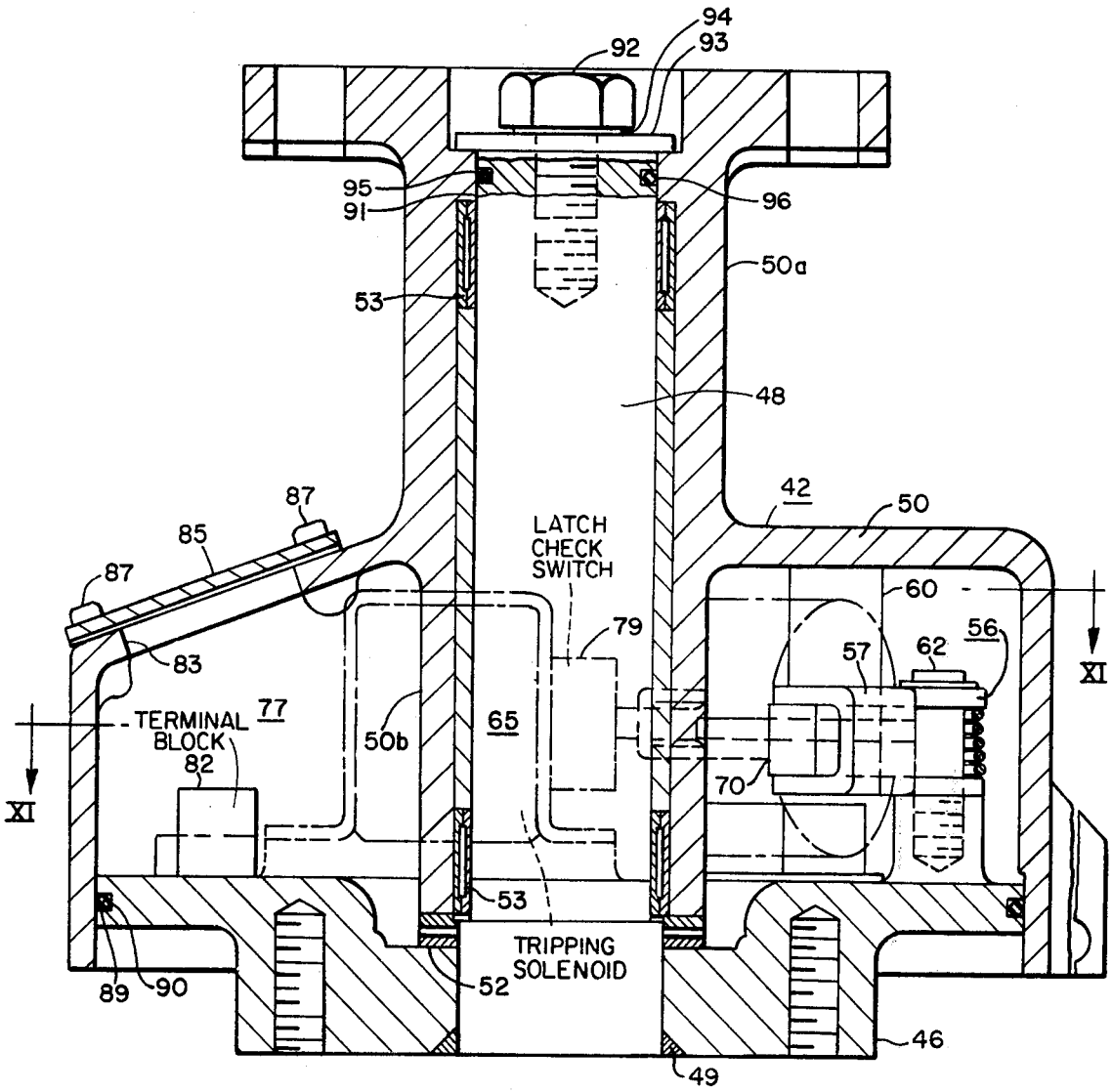
Figure 11:
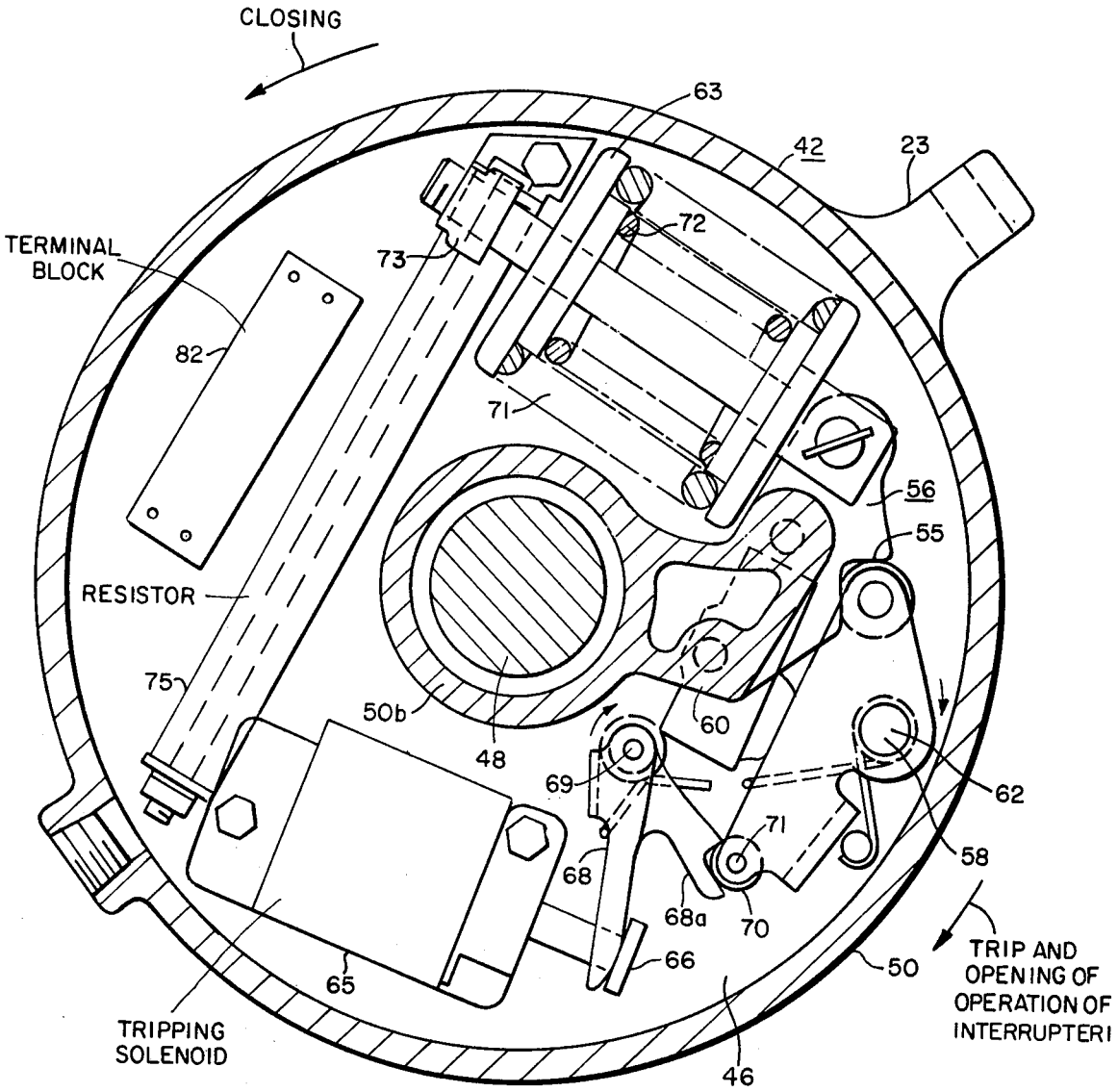
Figure 12:
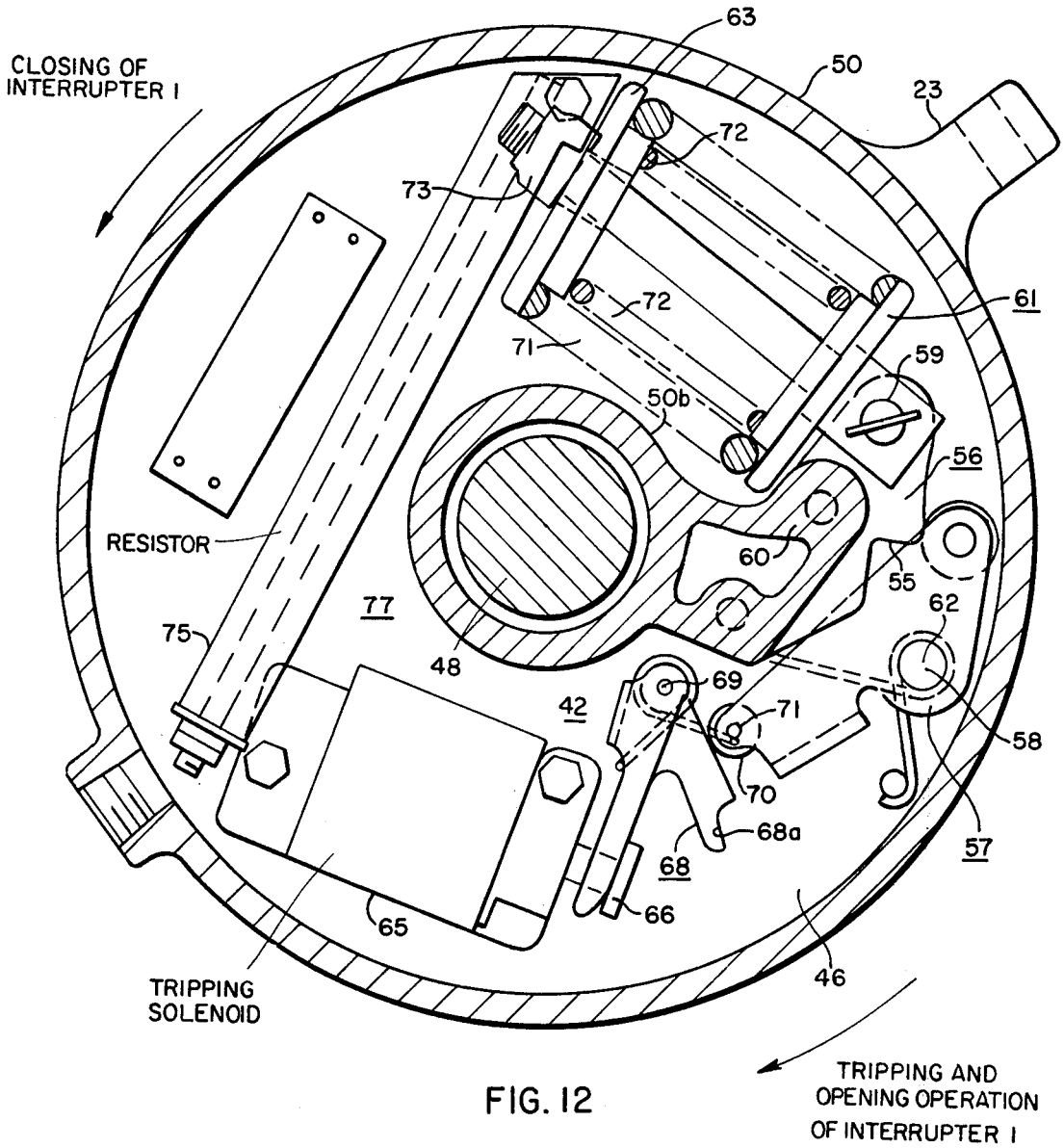
Figure 13:
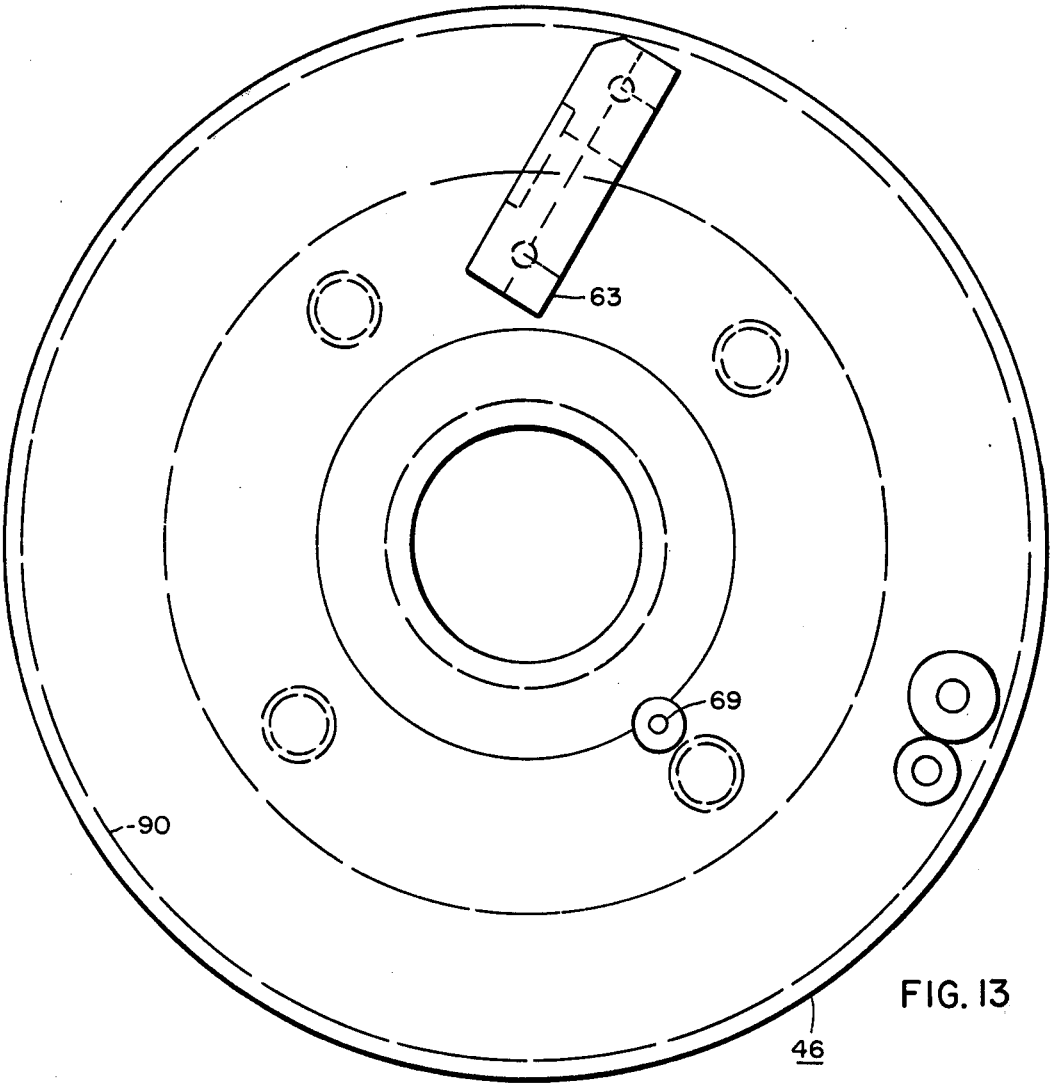
Figure 14:
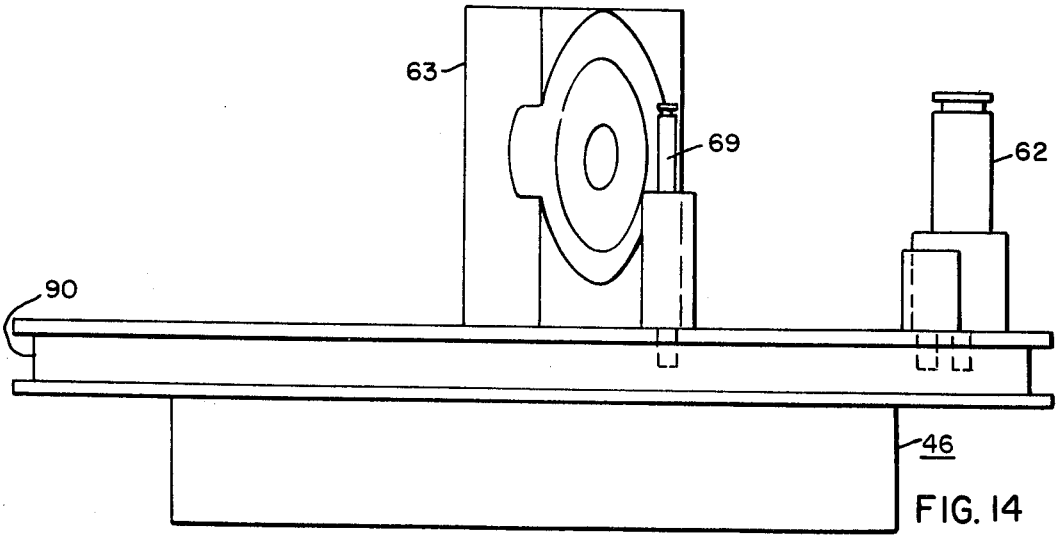
Figure 15:
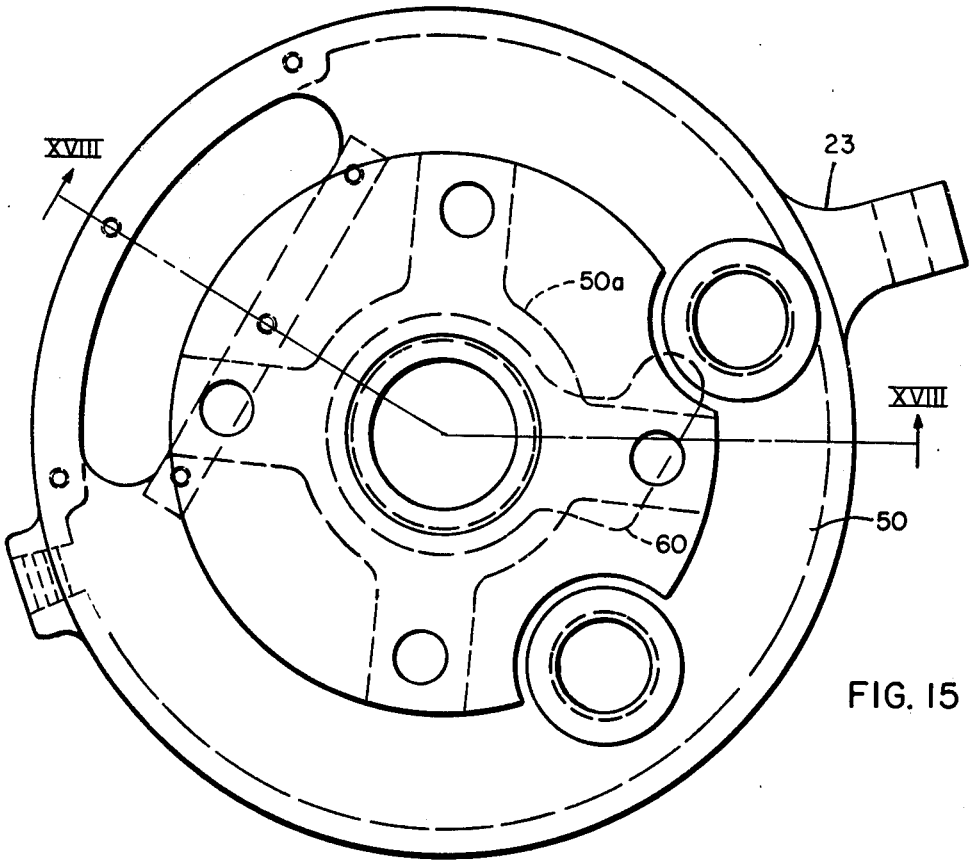
Figure 16:
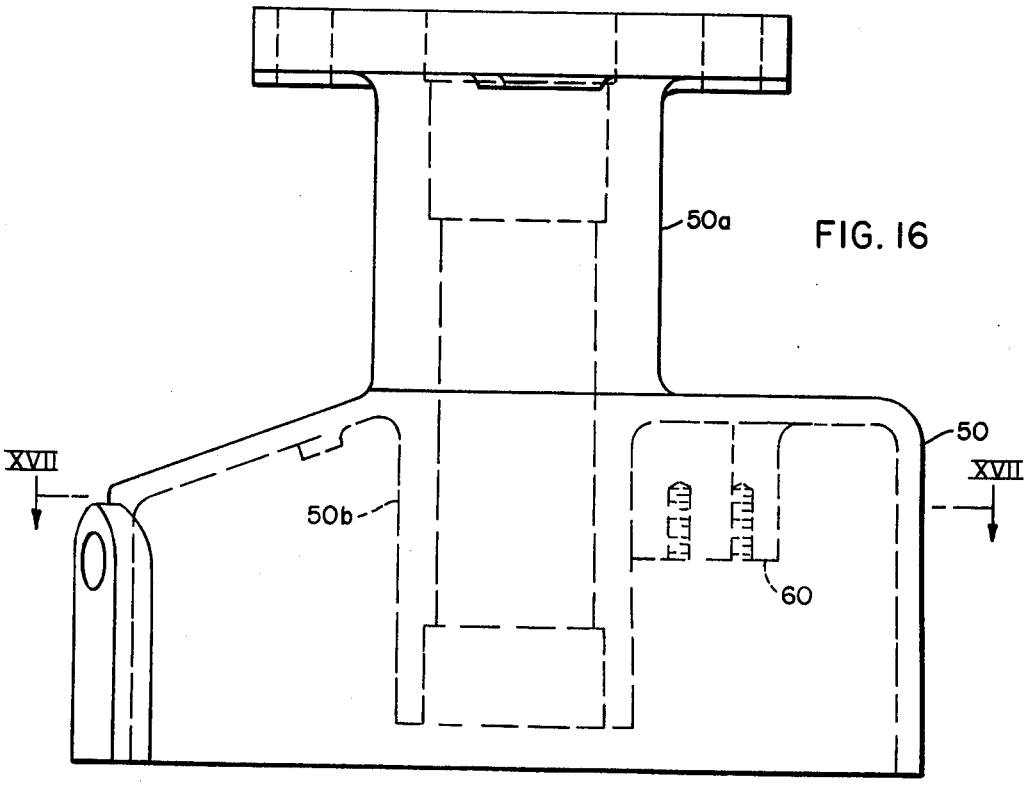
Figure 17:
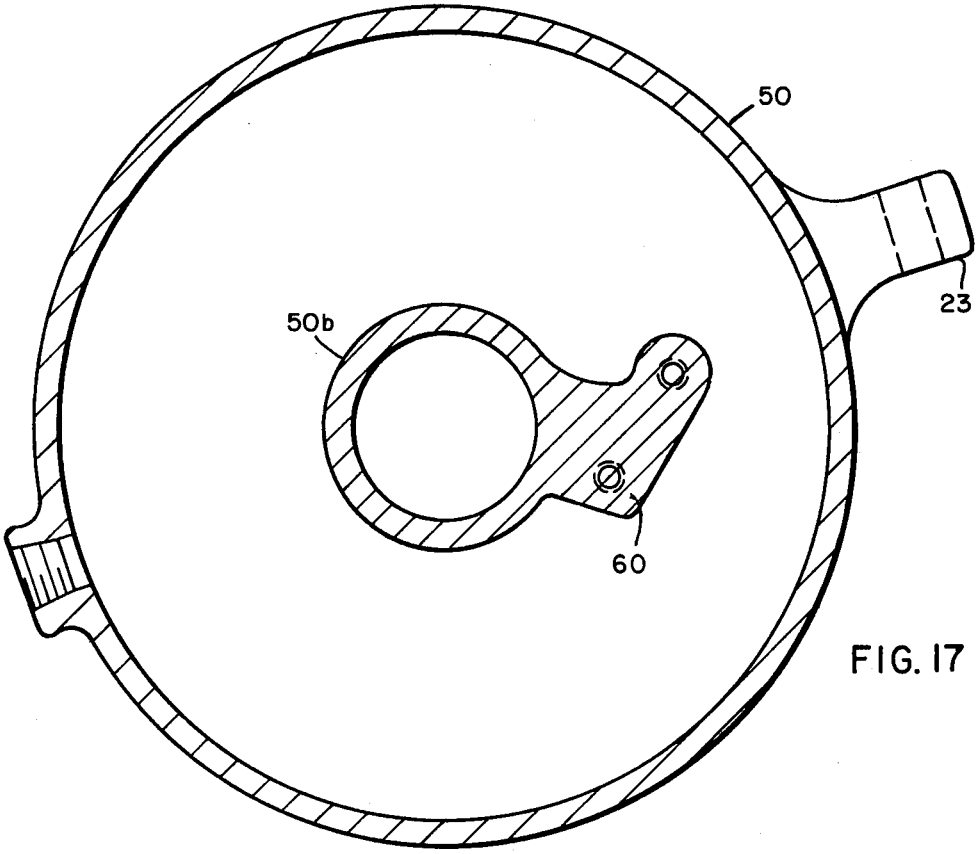
Figure 18:
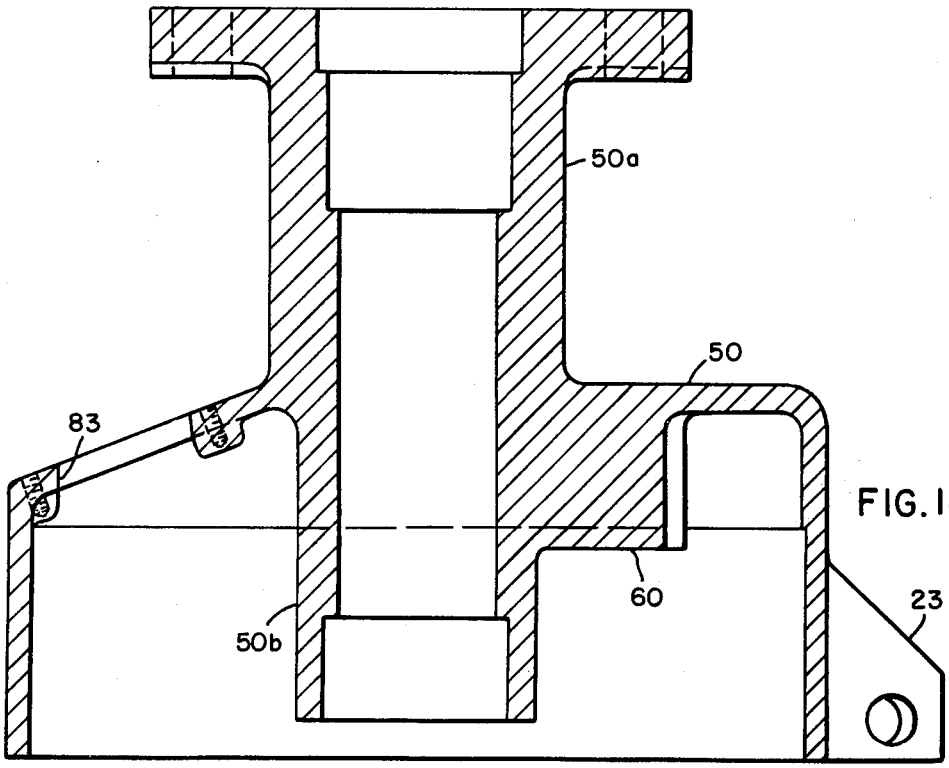
Figure 25:
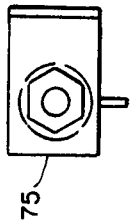
Figure 27:
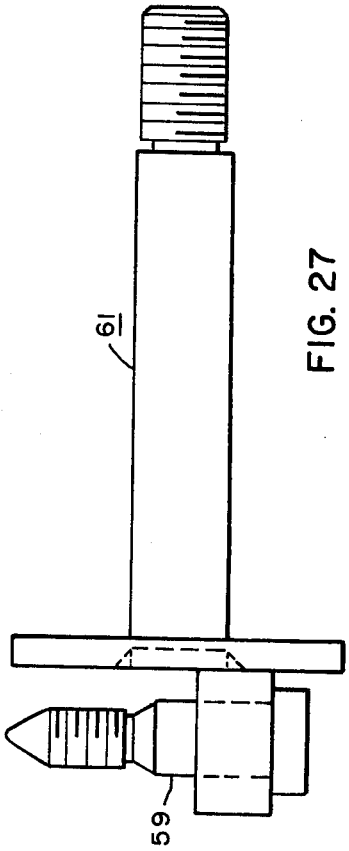
Figure 24:
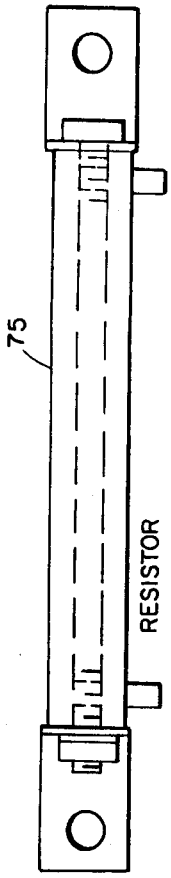
Figure 26:
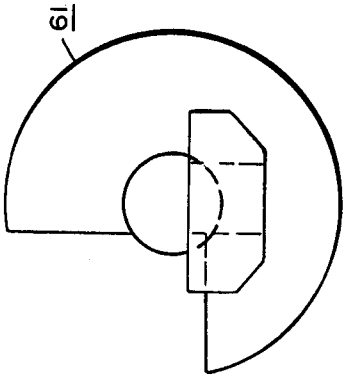
Figure 28:
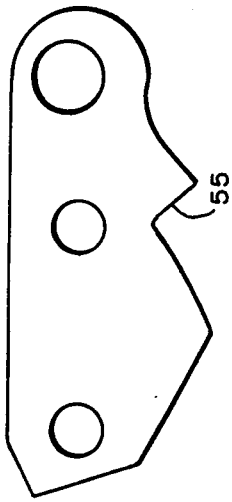
Figure 29:
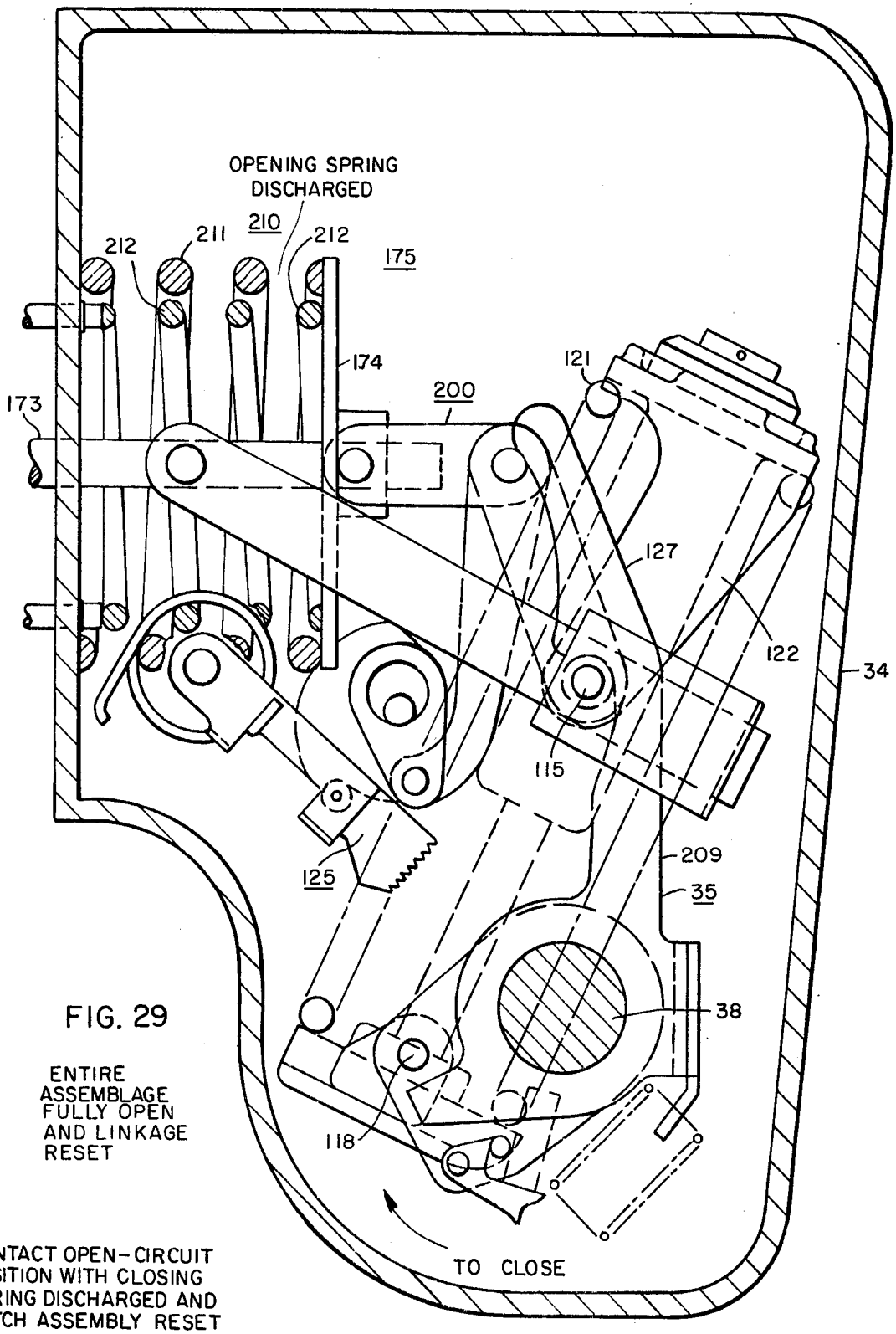
Figure 30:
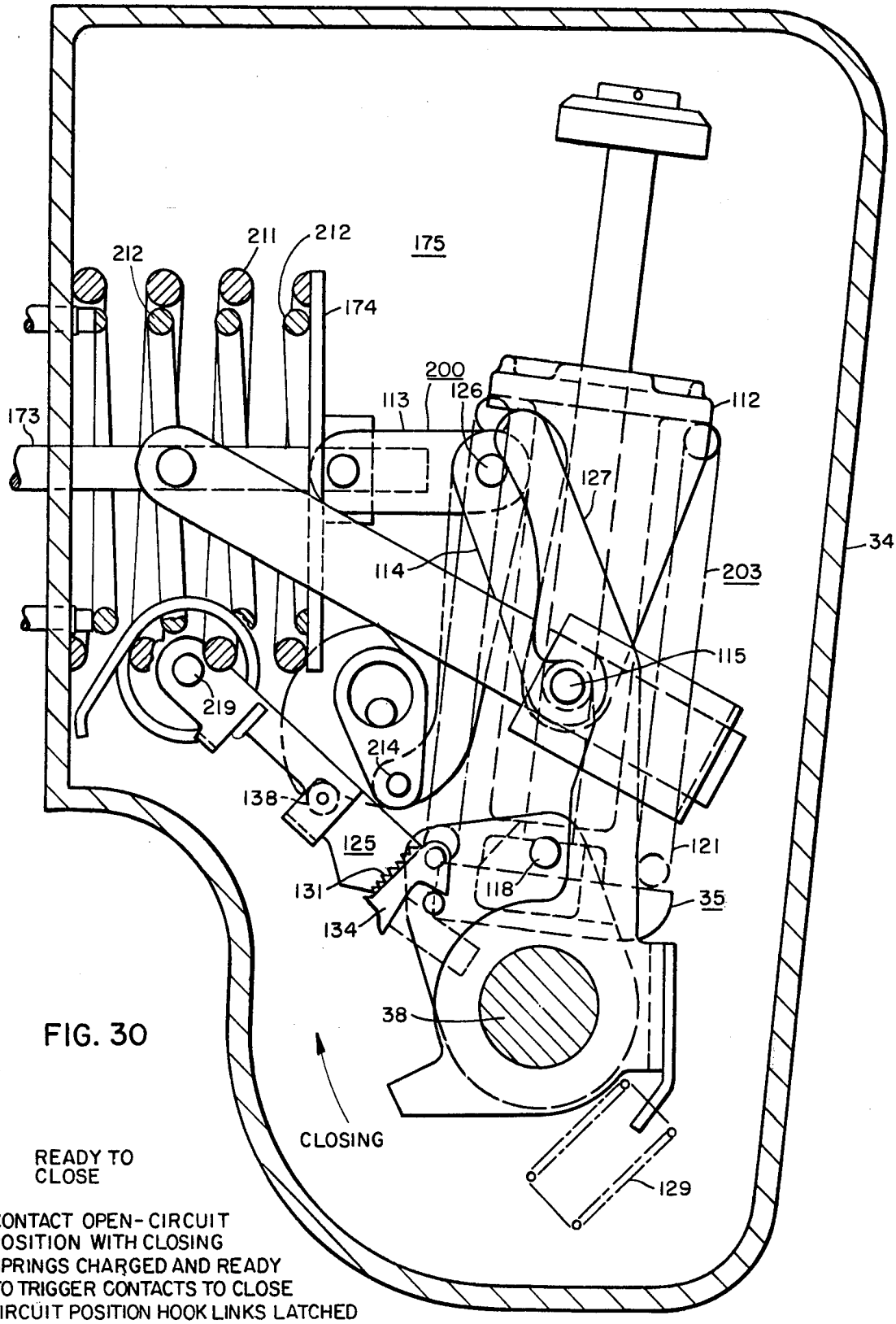
Figure 31:
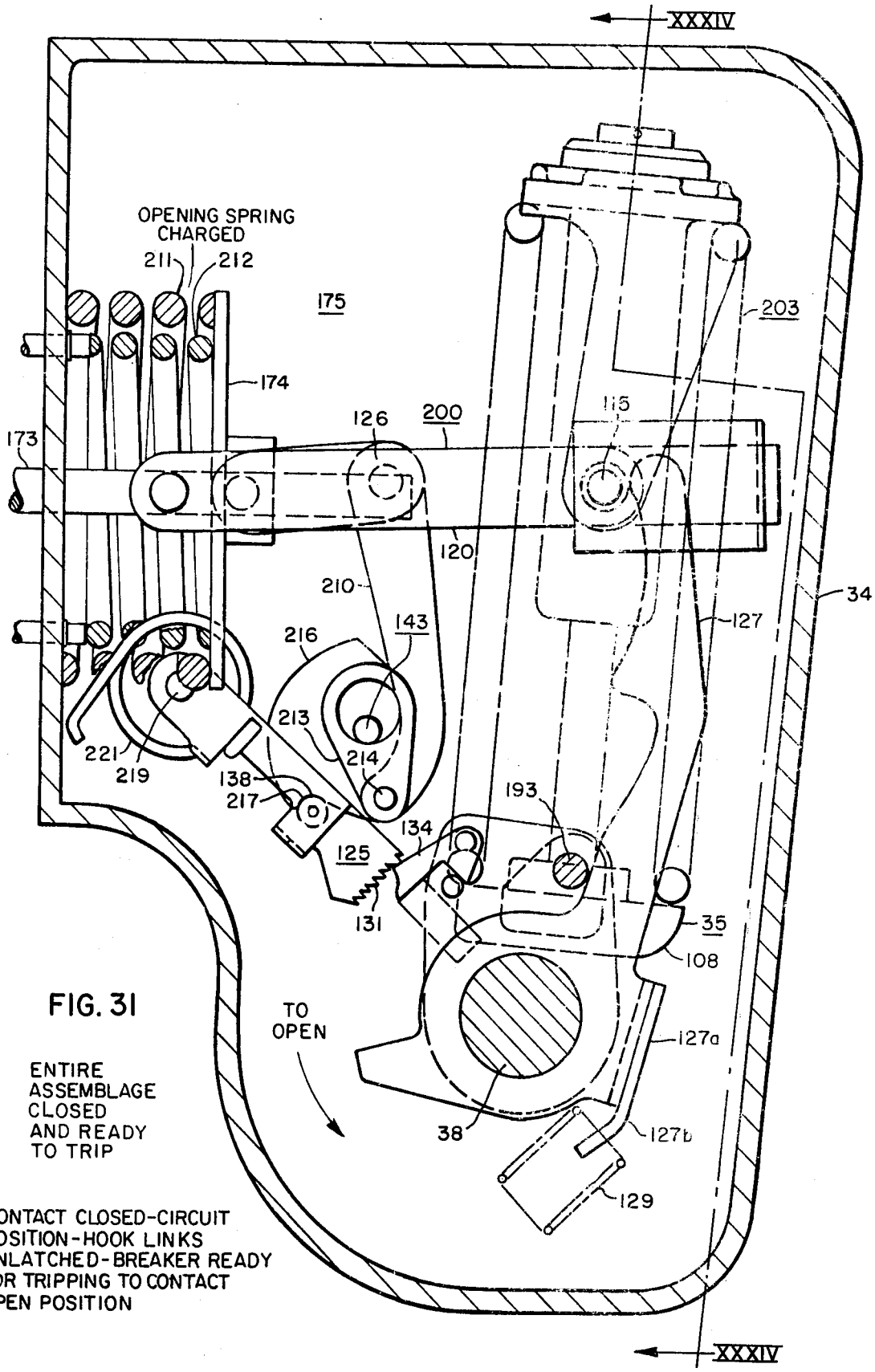
Figure 32:
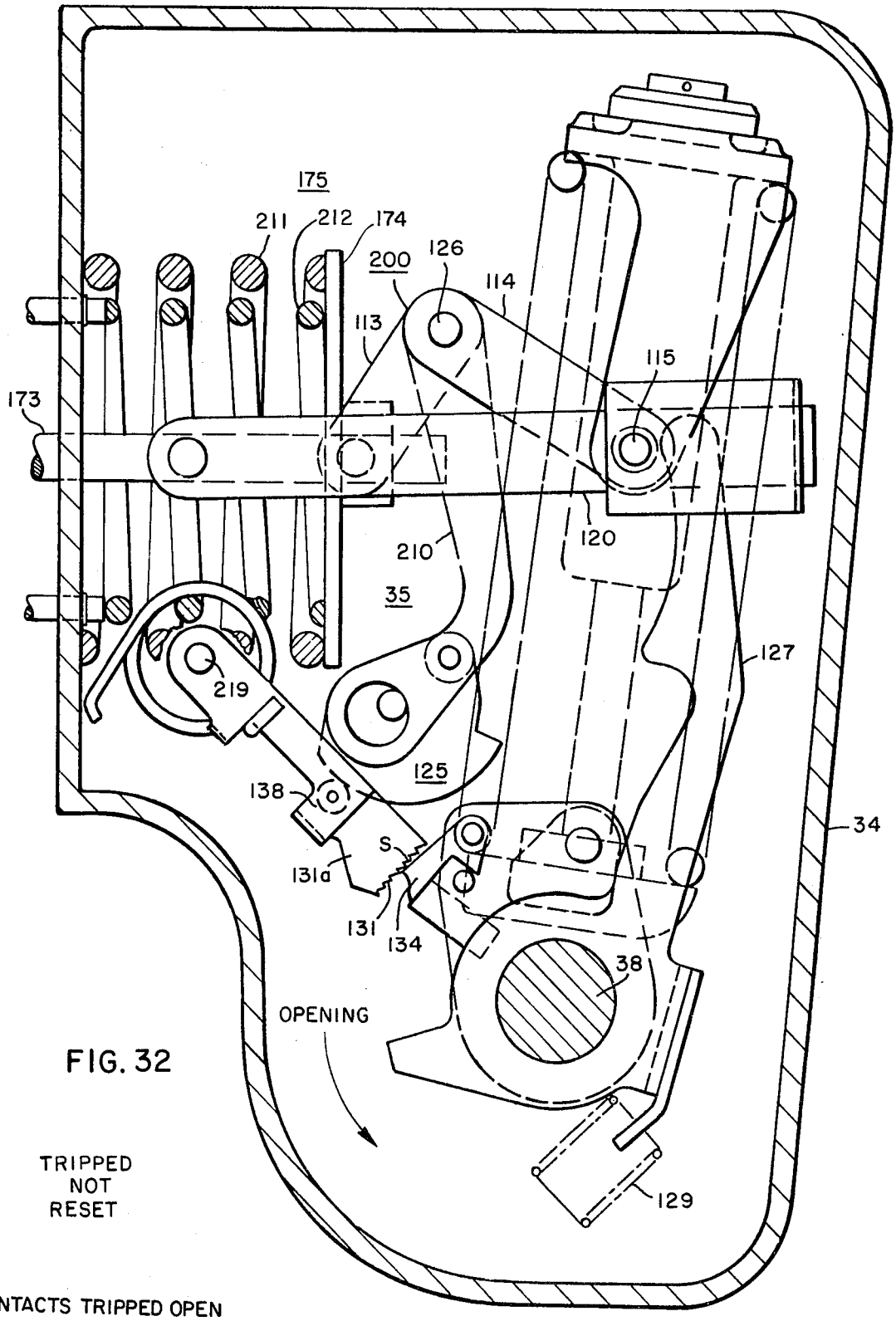
Figure 33:
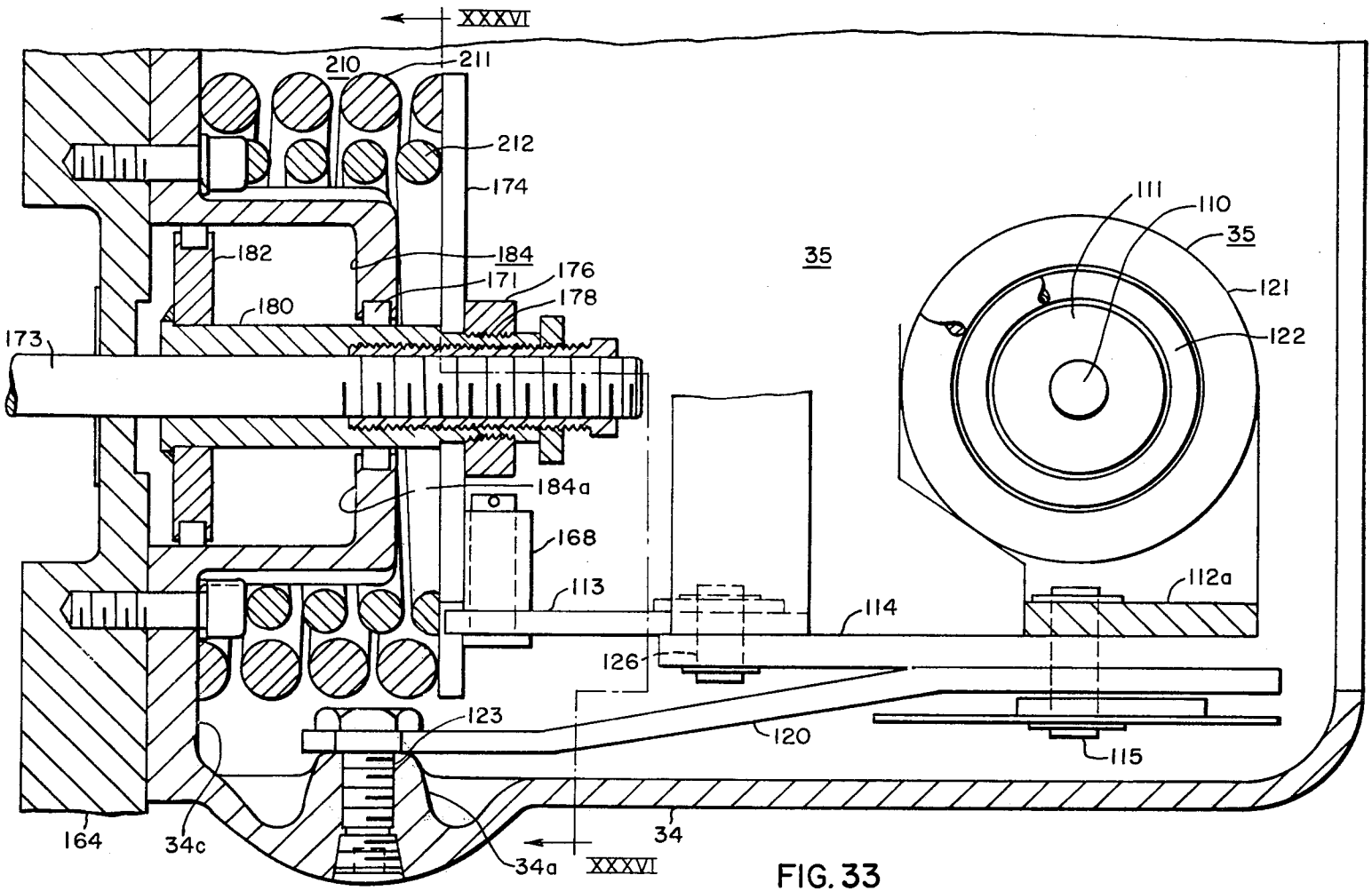
Figure 34:
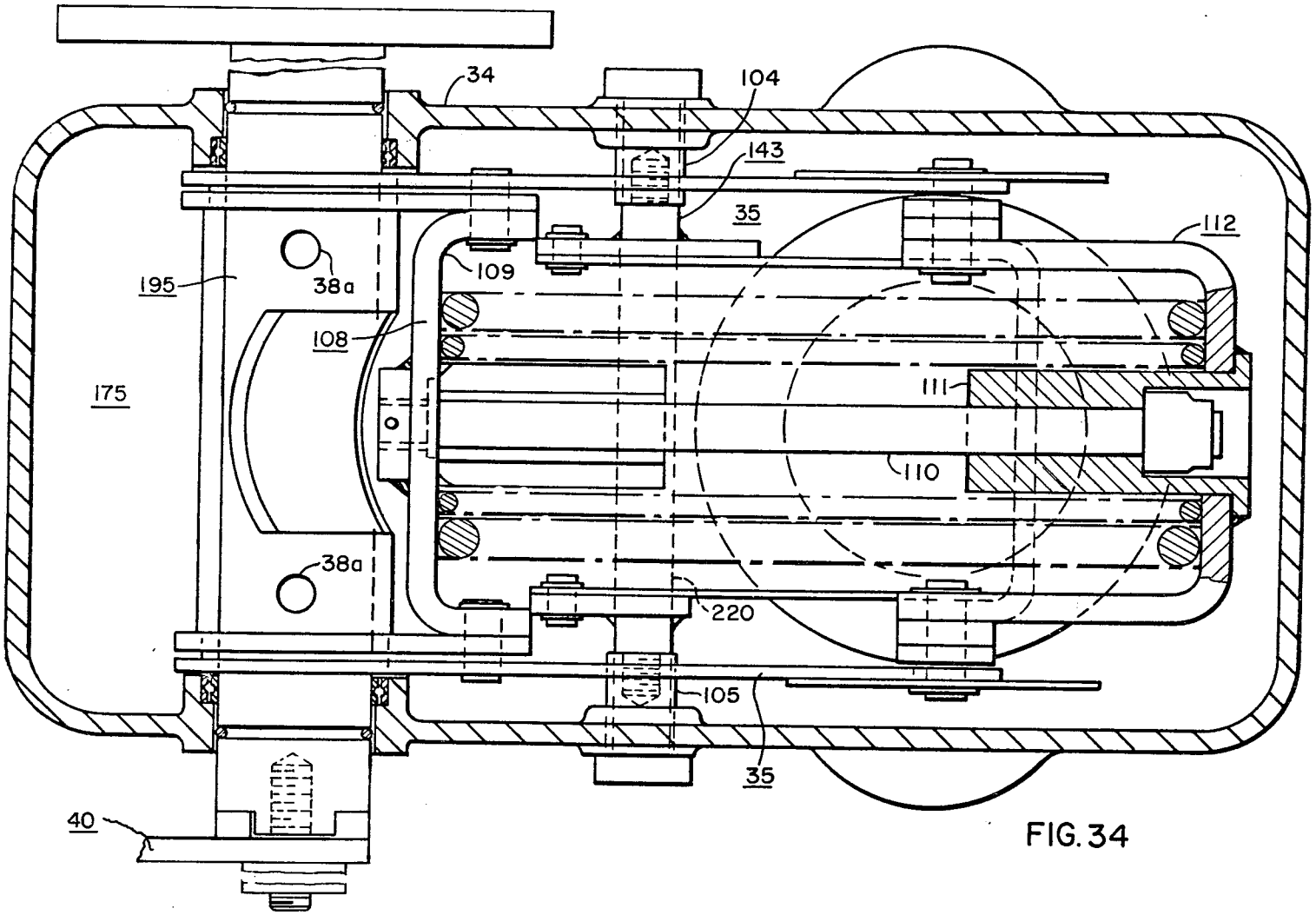
Figure 35:
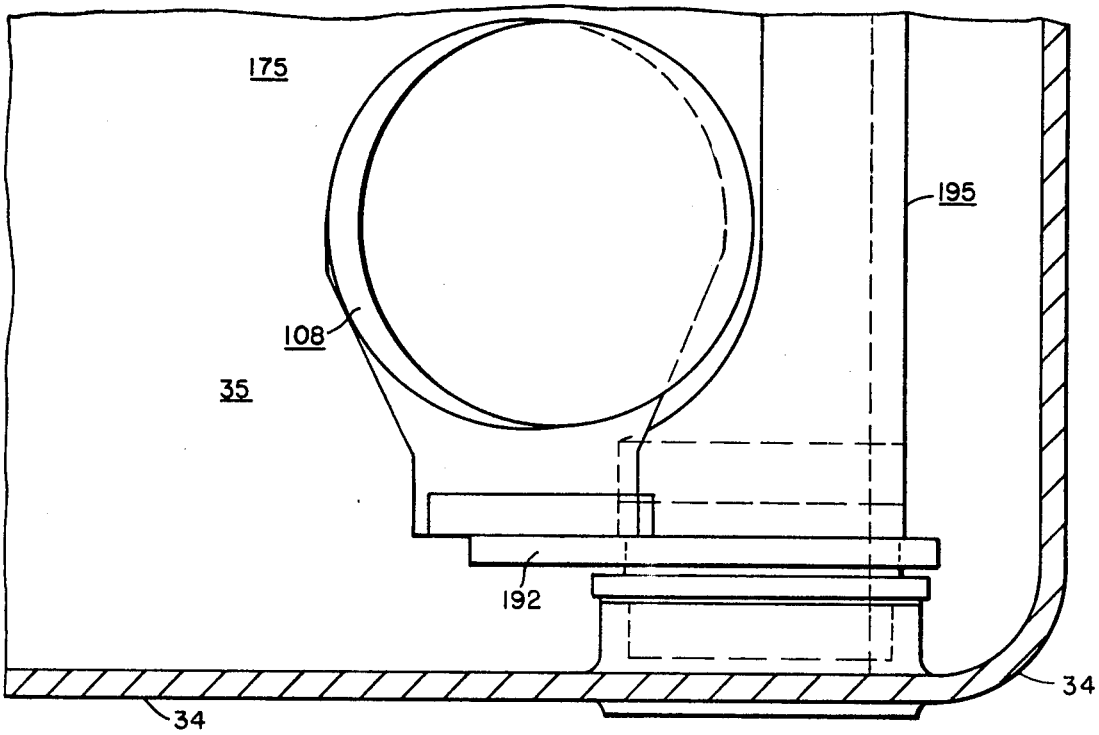
Figure 36:
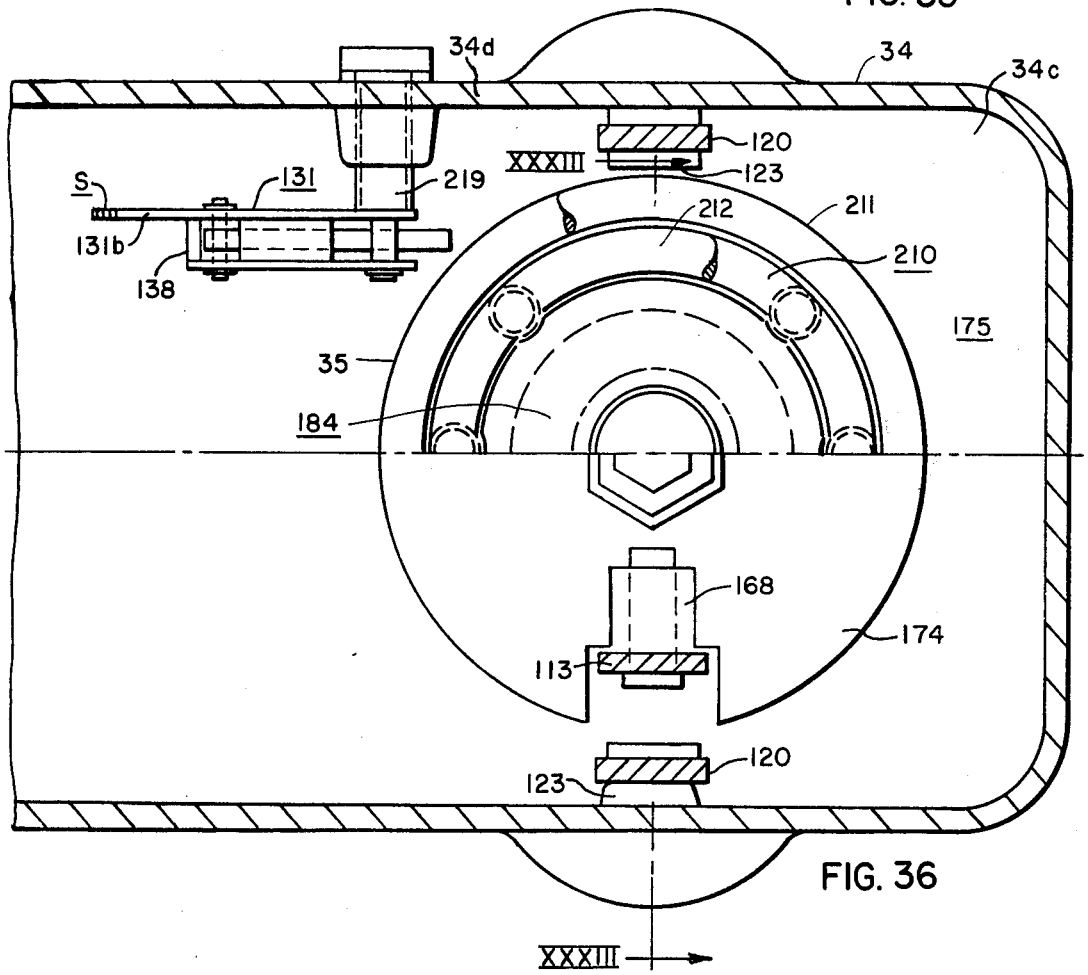
Figure 37:
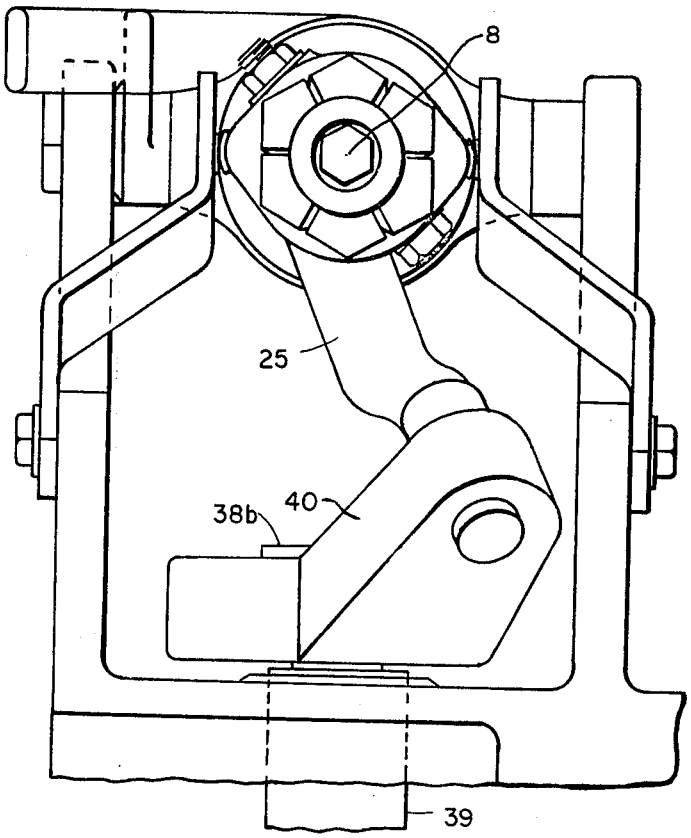
Figure 38:
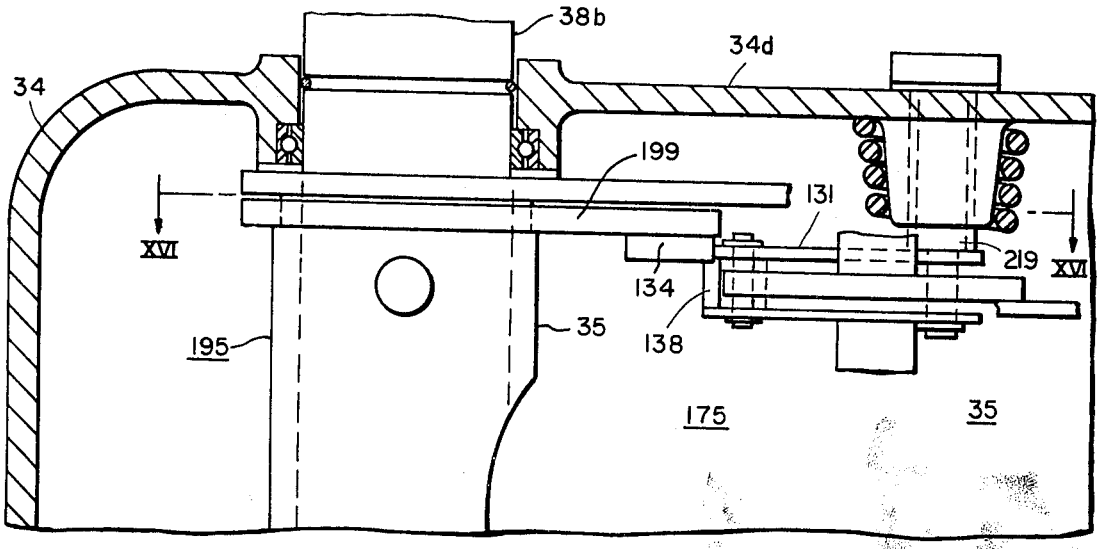
Figure 45:
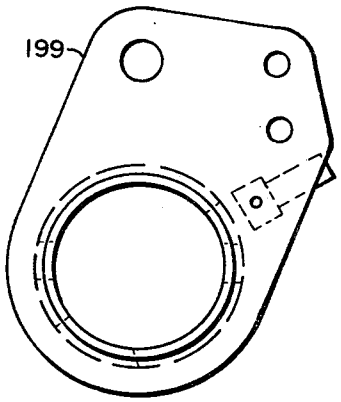
Figure 48:
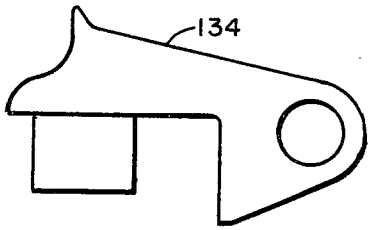
Figure 43:
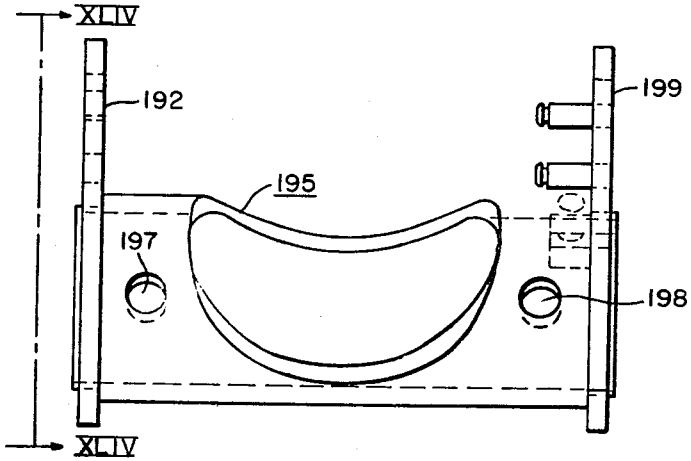
Figure 47:
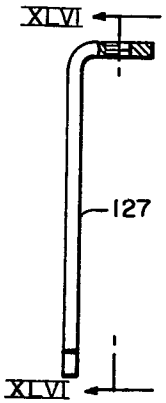
Figure 44:
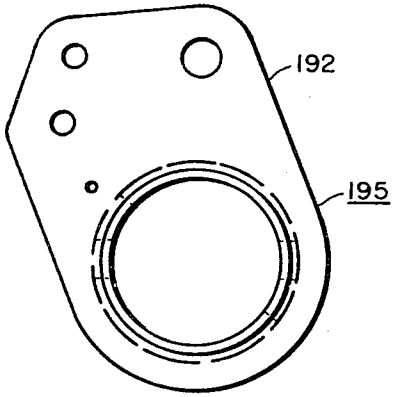
Figure 46:
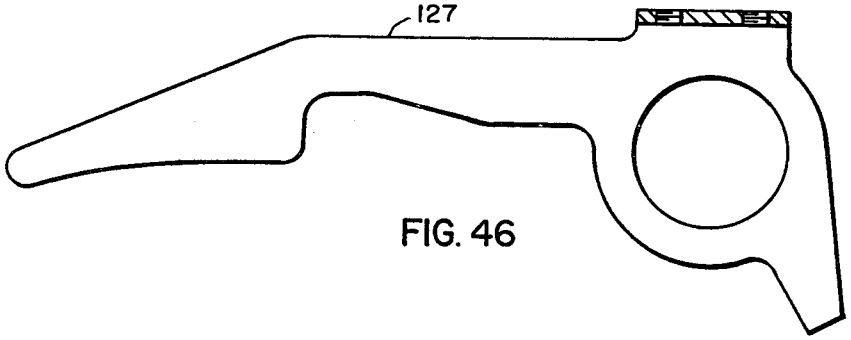
Figure 49:
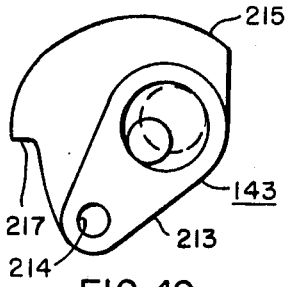
Figure 50:
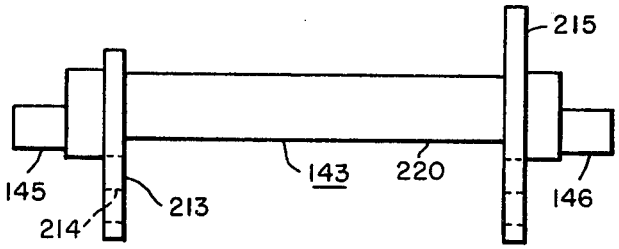
Figure 51:
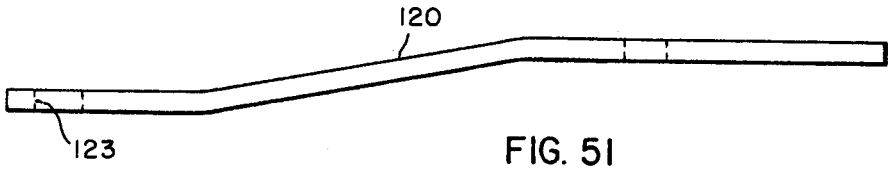
Figure 52:
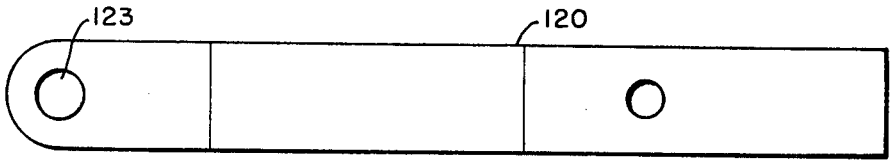
Figure 53:
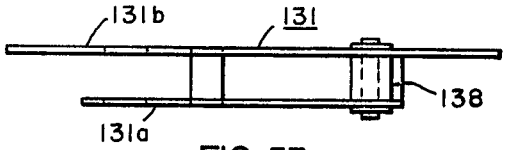
Figure 55:
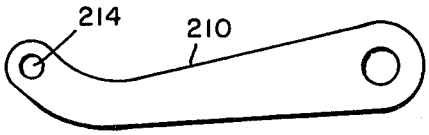
Figure 54:
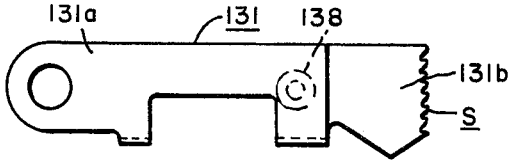
Figure 57:
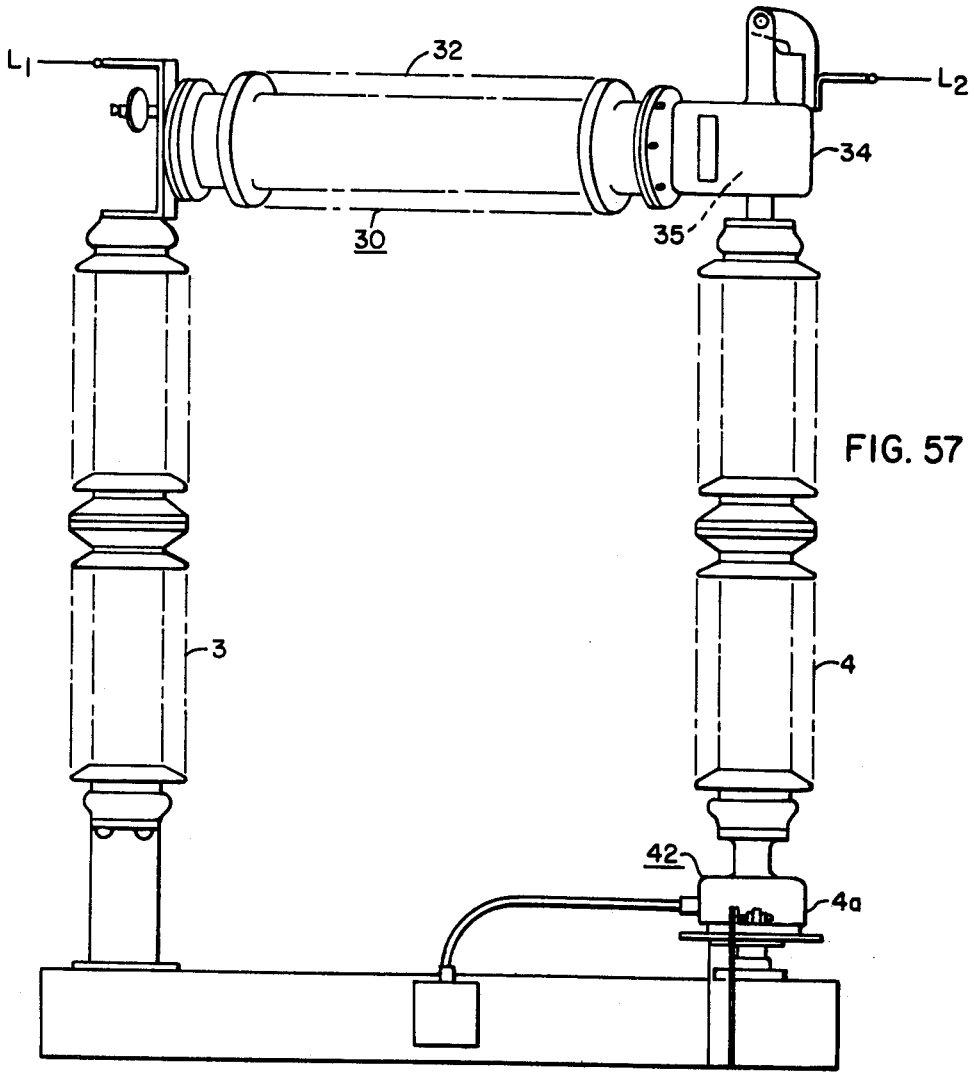

FIG. 5 is a fragmentary view, somewhat similar to that of FIG. 4, but illustrating the incorporation of the optional improved quick-acting accelerating tripping device of the present invention, disposed, as shown, at the lower end of the middle rotatable insulating operating column structure of the circuit-interrupting assemblage of FIG. 3, with spacers utilized at the end upstanding column structures, thus showing the tripping device as an optional feature;

FIG. 6 is an enlarged longitudinal sectional view taken longitudinally through the circuit-interrupter extending between the two upstanding column structures of FIG. 4, the contact structure being illustrated in the fully-open-circuit position, but for illustrative purposes, the gas-flow being indicated by the arrows within the gas-nozzle structure;

FIG. 7 is a fragmentary enlarged vertical sectional view, partially in end elevation, of the lower portion of the middle insulating column structure of FIG. 3, illustrating the adjustable drive levers, which mechanically interconnect the three pole-units, and also the operating drive lever which is connected to the motor-operated mechanism of the device;

FIGS. 8 and 9 illustrate plan views of the two adjustable operating drive levers of FIG. 7 to illustrate their construction;

FIG. 10 is an enlarged vertical sectional view taken through the lower end of the central rotating operating column structure, showing the rotatable upper cover-casting, and also the association therewith of a portion of the lower base-spindle structure, providing relative rotative motion between these two parts, the two component parts being illustrated in the latched spring-charged condition;

FIG. 11 is a sectional view taken substantially along the line XI—XI of FIG. 10, illustrating the latched spring-charged condition of the relatively two rotatable parts;

FIG. 12 is a view similar to that of FIG. 11, but illustrating the released unlatched condition of the latching assembly interconnecting the two relatively-rotatable parts, and the view also illustrating the uncharged relaxed condition of the compression-spring biasing means;

FIG. 13 is a top plan view of the lower rotatable base-spindle support;

FIG. 14 is a side-elevational view of the lower rotatable base spindle-support of FIG. 13;

FIG. 15 is a top plan view of the upper rotatable cover-casting associated with the lower end of the middle rotatable operating supporting insulating column structure of the device, which effects actuation and tripping of the circuit-interrupter mechanism, the latter, however, being disposed at high-potential at the upper end of said middle supporting insulating operating column structure;

FIG. 16 is a side-elevational view of the upper rotatable cover-casting of FIG. 15;

FIG. 17 is a plan view, in section, taken substantially along the line XVII—XVII of FIG. 16;

FIG. 18 is a vertical sectional view taken substantially along the line XVIII—XVIII of FIG. 15, looking in the direction of the arrows;

FIGS. 19 and 20 are, respectively, side and front elevational views of the rotatable trigger-assembly, which is supported upon the lower rotatable base-spindle support;

FIGS. 21 and 22 are side and top plan views of the rotatable latching lever-assembly;

FIG. 23 is a plan view of the coverplate for covering the inspection opening provided in the rotatable upper cover-casting of FIGS. 15 and 16;

FIGS. 24 and 25 are side elevational and end views of the heater-resistor assembly utilized for heating purposes within the interior of the cover-casting assembly to prevent condensation therein during operation of the device;

FIGS. 26 and 27 are, respectively, side-elevational and end-elevational views of the biasing spring-retainer rod-end assembly;

FIG. 28 is a plan view of the latch movable with the upper cover-casting;

FIG. 29 is an enlarged sectional view taken through the operating mechanism for the circuit-interrupter at the upper end of the device at high voltage, the several parts being shown in the fully-open-circuit position of the circuit interrupter, and the linkage parts being in the reset condition;

FIG. 30 is a view similar to that of FIG. 29 but illustrating the position of the several mechanism parts at a point in time at which the circuit-interrupter contacts are just about to be closed by release of the opening-spring storage means;

FIG. 31 is a view similar to those of FIGS. 29 and 30, but illustrating the position of the several linkage parts in the closed-circuit position of the circuit-interrupter, and the device being ready to trip to the open-circuit position;

FIG. 32 is a view similar to those of FIGS. 29–31, but illustrating the position of the several mechanism parts of the interrupter in a tripped released condition, with the interrupter contacts open, but the linkage parts not being yet reset;

FIG. 33 is an enlarged sectional view taken substantially along the line XXXIII—XXXIII of FIG. 36;

FIG. 34 is a vertical sectional view taken substantially along the line XXXIV—XXXIV of FIG. 31;

FIG. 35 is a partial fragmentary sectional view taken substantially along the line XXXV—XXXV of FIG. 29;

FIG. 36 is a broken fragmentary sectional view taken substantially along the line XXXVI—XXXVI of FIG. 33;

FIG. 37 is a fragmentary view looking in the direction of the line XXXVII—XXXVII of FIG. 4;

FIG. 38 is a fragmentary vertical sectional view taken substantially along the line XXXVIII—XXXVIII of FIG. 30;

FIG. 39 is a side-elevational view of the vertically-disposed operating-shaft assembly for the mechanism for operating the circuit-interrupter contacts;

FIG. 40 is an end elevational view of the operating-shaft assembly of FIG. 39;

FIG. 41 is a side-elevational view of the closing-spring retainer assembly for the closing-spring energy-storage assemblage;

FIG. 42 is a front elevational view of the retainer-spring assemblage of FIG. 41; but illustrating the addition thereto of the closing-spring assemblage supported therein;

FIG. 43 illustrates a side-elevational view of the operating-lever crank-arm sleeve-assemblage, which encompasses the operating-shaft assembly of FIG. 39, illustrating the end operating levers or operating cranks therefor;

FIG. 44 is an end-elevational view of the operating-sleeve assemblage of FIG. 43 illustrating one crank-arm;

FIG. 45 is an end-elevational view of the other end of the operating-sleeve assemblage of FIG. 43 illustrating the other crank-arm;

FIG. 46 is a detailed view of the holding-lever utilized in the operating mechanism for operating the circuit-interrupter;

FIG. 47 is an end-elevational view of the holding-lever of FIG. 46;

FIG. 48 is a plan view of the pawl for the latch-assembly for releasing the toggle-linkage of the circuit-interrupter;

FIG. 49 is an end-elevational view of the off-center tripping rod assembly for releasing the toggle-linkage of the interrupter mechanism;

FIG. 50 is a side-elevational view of the off-center tripping rod assembly of FIG. 49;

FIGS. 51 and 52 are side-elevational and top-plan views of the guide-link utilized in the improved mechanism;

FIGS. 53 and 54 are, respectively, top-plan and side-elevational views of the serrated rotatable latch-assembly utilized in the improved mechanism of the present invention;

FIG. 55 is a side-elevational view of one of the control-links utilized for latching the releasable toggle mechanism of the present invention;

FIG. 56 is a diagrammatic view of the electrical control-circuit for energizing the tripping solenoids of the pole-units for the improved accelerating tripping devices of the present invention, together with the synchronizing relationship with the motor for operating the device;

FIG. 57 is an alternate embodiment of the invention wherein a disconnecting switchblade is not used in series with a circuit interrupter, but nevertheless, the advantageous features of the improved accelerating tripping device of the present invention may be employed with a circuit-interrupting assemblage having the same operating mechanism as illustrated hereinbefore; and, FIG. 58 illustrates a modified-type of quick-acting spring-charged accelerating tripping assembly, which may be utilized as an alternate for the quick-acting, accelerating, spring-charged tripping assembly of FIGS. 10, 11 and 12 of the drawings.

DESCRIPTION OF THE PREFERRED EMBODIMENTS

Modern circuit-breakers are efficient and reliable devices and perform their duties adequately. However, they are large and expensive; and in many cases, economies can be achieved with less-expensive devices. Such devices have been avaiable for several years and range from load-interrupter switches, with interrupting ratings approximating their continuous-current-carrying capabilities, to devices, which can interrupt a few thousand amperes with modest transient-recovery capabilites.

Over the past few years, development work performed with $SF_6$ gas-puffer-type circuit-interrupters has led to improvements in these gas-type devices. Some of these improvements have been incorporated into medium-fault-interrupting class devices, such as set forth in the instant patent application, thus expanding their field of application. Some of the advantages, attained by the invention set forth herein, include:

a. Simplicity of construction;

b. 10,000 amperes interrupting capacity at 169 KV, for example, on a single-break interrupter without using shunt capacitors or resistors;

c. Transient-recovery capability on bus faults corresponding to capability of circuit-breakers at maximum rating;

d. Full insulation strength across the open contacts of the interrupter without requiring an open disconnect switch;

e. High-speed circuit-making and breaking in pressurized $SF_6$ gas which eliminates any arcing in air;

f. Low noice level during switch operation.

Figure 1:
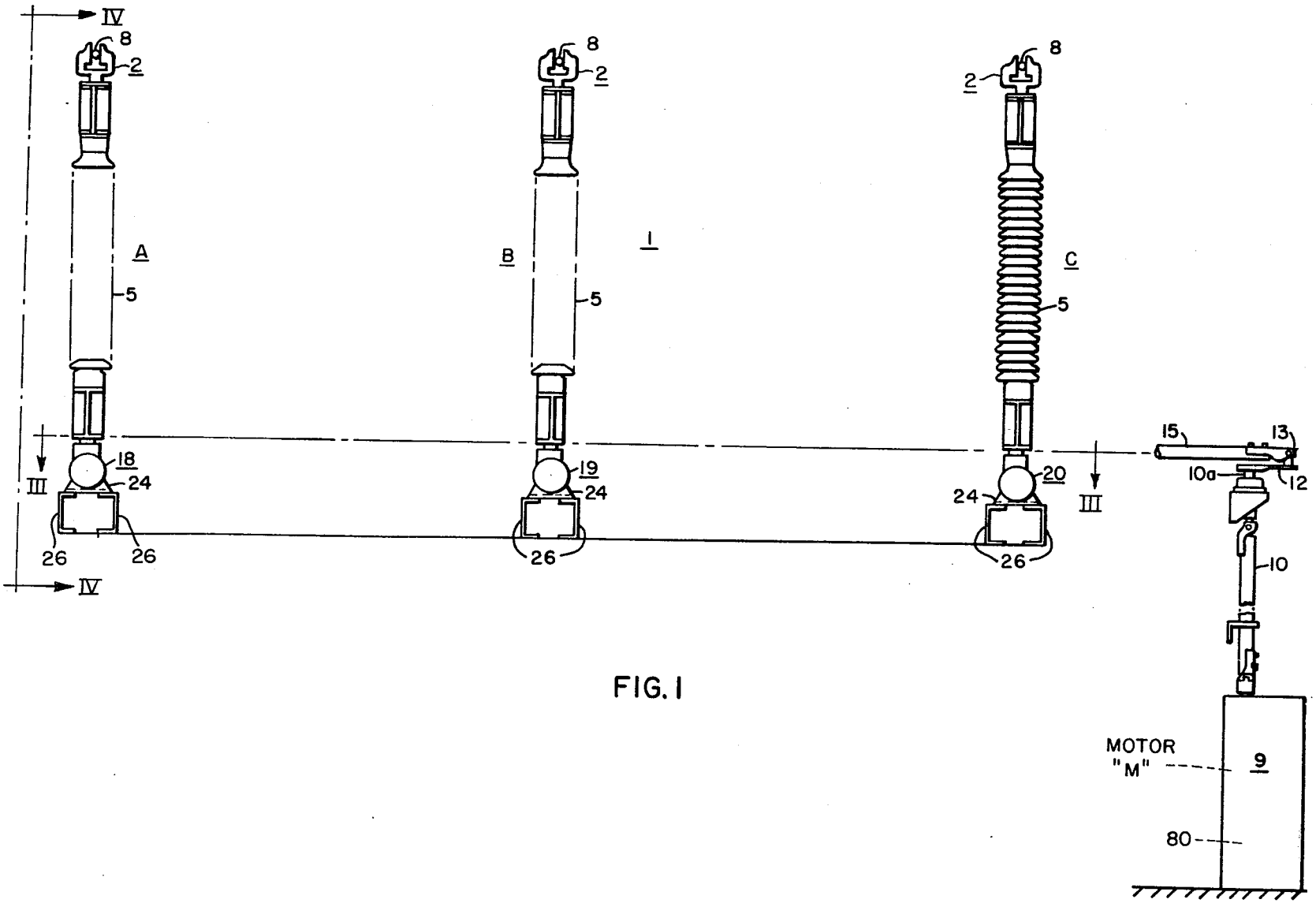

Referring to the drawings, and more particularly to FIGS. 1–4 thereof, the reference numeral 1 generally designates a circuit-interrupting structure including three upstanding post insulators 3, 4 and 5 (FIG. 4). The two end post insulators 3 and 5 being stationary, whereas the middle post insulator 4 is rotatable, being driven from its lower end by an operating-crank 7 (FIGS. 2 and 3) connected to any suitable operating mechanism 9, as shown in FIGS. 1 and 3. Such an operator 9 may be a motor-driven device, or in certain instances the crank-operator 9 may be manually driven.

In more detail, the operating mechanism 9, which may be of any suitable type, effects rotation of a vertically-extending operating shaft 10, to the upper end of which 10*a* (FIG. 1) is affixed to rotatable crank-arm 12. To the outer free end of the crank-arm 12 is a pivotally connected, as at 13, an interconnecting horiziontally-disposed operating rod 15, the latter being pivotally connected to an actuator 14 (FIG. 3) at pivot point 11. The several operating cranks 7 are consequently mechanically connected by a rod 6 (FIG. 3) to act in unison. The several operating cranks 7 are associated with the lower end 4*a* of each of the three middle rotatable operating insulator posts 4 of the three pole-units "A", "B" and "C" of the three-phase circuit interrupter 1.

FIG. 1 also shows the three base supporting structures 18, 19 and 20, which may be of cylindrical form, or, alternatively, channel-shaped, as shown in FIG. 7, and are supported by welded brackets 24 to cooperating channel members 26, which face inwardly, as illustrated in FIGS. 1 and 7.

Extending between each end post insulator 3 and the middle rotatable driving post insulator 4 is an interrupting assembly, or a circuit-interruptor 30 (FIGS. 2 and 4), which encloses one or more serially-related separable contact structures 31 (FIG. 6), which may be of any suitable type —for instance, of the gas-puffer type set forth in FIG. 6 of the drawings, which may, for example, use sulfur-hexafluoride ($SF_6$) gas, but generally constituting no part of the present invention.

Referring again to the drawings, and more particularly to FIGS. 3 and 4 thereof, it will be observed that one application of the present invention is in connection with a circuit-interrupting device 30 (FIG. 6) having a serially-related disconnecting switchblade 8 associated therewith for obvious safety reasons. Those skilled in the art may call such a structure a "load-break disconnecting switch", in which the circuit-interrupting structure 30 is utilized to actually break the load-current passing through the device 1, and the function of the disconnecting switchblade 8 itself is merely to effect a visible open-circuit condition of the device 1, so that maintenance people may work upon the connected electrical line without fear of high-voltage shock occuring.

As illustrated in FIGS. 4 and 5, it will be observed that there is provided a lower-disposed base-assembly 18 having supporting brackets 24 and having welded to the upper portion thereof additional brackets 21 to fixedly support the insulating column structures 3 and 5.

With reference to FIG. 4, it will be observed that extending upwardly from the elongated base support 18, which may be of generally tubular configuration, if desired, are stationary insulating columns 3 and 5, which support a righthand line-terminal 27 and a lefthand load-terminal 28, with a circuit-interrupting assemblage 30 enclosed within a hermetically-sealed housing 32 extending between the load-terminal 28 and a generally box-shaped metallic mechanism housing 34, which has a mechanism 35 disposed therewithin, a description of which will be given hereinafter. Electrically interconnecting the metallic mechanism housing 34 and the line-terminal 27 is a swinging disconnecting switchblade 8, which provides an open-circuit visible gap between the line-terminal 27 and the mechanism housing 34 in the fully open-circuit position of the circuit-interrupter 30. The dotted lines 37 indicate, generally, an upstanding openciruit position of the disconnecting switchblade 8, as well known by those skilled in the art.

It will be observed that the end insulating columns 3 and 5 are stationary, merely providing a supporting function, whereas the middle insulating column 4 is rotatable, and constitutes an operating function, having an upper extending shaft-portion 38, which extends interiorly within the mechansim housing 34, and serves to actuate the operating mechansims 35 provided therein. The upstanding operating shaft 38 extends, moreover, upwardly through the mechanism housing 34, terminating in a crank-arm 40 (FIG. 37), and actuates the opening swinging motion of the disconnecting switchblade 8. FIG. 37 may be referred to, to more clearly illustrate the crank-arm construction. In other words, the upper end of the operating shaft 38 effects rotative opening and closing movements of the crank-arm 40, which, in turn, effects rotation and swinging opening and closing motions of the serially-related disconnecting switchblade 8.

The accelerating quick-acting tripping device 42 of the present invention may be provided as an optional feature. By this, it is meant that it may be omitted, and the interrupting device 1 may function as set forth in FIG. 4 of the drawings, but the opening tripping motion, provided by the motor-operator 9, will be relatively slow, taking roughly an additional tripping time of substantially half a second. For certain applications, however, it is desirable not to rely upon the relatively slow opening operation of the interconnecting linkage structure 6, 15 in the motor-operated mechanism, illustrated in FIGS. 1 and 2, which may approach one-half second in time duration. It will be obvious that because of the inherent lost-motion and somewhat loose mechanical connetions in the relatively long linkage structure 6, 15, the time elapsed between operation of the motor mechanism within the motor-operated compartment 9 and the interconnecting linkage to effect ultimate rotation of the center insulator operator columns 4 of FIG. 3 would be relatively long.

Accordingly, to effect a quick-opening tripping operation of the mechanism 35, disposed within the mechanism housing 34 of FIG. 3, thereby effecting a very quick opening releasing actuation of the separable contacts 31 within the circuit-interrupting assemblage 30, the device 42 of the present invention may readily be incorporated, either at the factory or, optionally in the field, if desired, with relatively slight effort. Naturally, spacers 33, as shown in FIG. 5, may be used to accommodate the slight additional height required for employing the accelerating tripping device 42 of the present invention as an optional feature in connection with the middle operating driving column structure 4 of FIG. 5.

With reference to FIG. 7 of the drawings, it will be observed that there is provided a lower rotatable base-spindle support 44, resembling a turn-table, having bolted thereto, as at 45, and surmounting thereon, a lower rotatable operating base 46. The rotatable base 46 (FIGS. 13 and 14) has a steel shaft 48 (FIG. 10) welded thereto, as at 49, which extends upwardly, as shown in FIG. 10. Enveloping the upper end of the upstanding steel support shaft 48, the latter being fixedly secured, as by welding 49, to the lower base-spindle support 46, is a relatively movable upper cover-casting member 50 (FIGS. 15 and 16). With further reference to FIG. 10 of the drawings, it will be apparent that the upper cover-casting member 50 has an elongated tubular portion **50*a* (FIG. 16) with a lower extension portion 50*b* integrally formed therewith, which slides and rotates relative to the upstanding steel-shaft member 48, and, by virtue of thrust bearings 52, (FIG. 10) and needle bearings 53, has frictionless relative rotative motion between the two such base members 46 and 50. The upper rotatable cover-casting member 50, in addition, carries a latch stop 55 (FIG. 28) of a latching assembly 56 (FIG. 12), the latching stop 55 being fixedly secured to the lower side of a downwardly-extending projection 60 (FIG. 16) constituting an integral portion of the upper rotatable cover-casting 50, in a manner more clearly illustrated in FIGS. 11, 12 and 16 of the drawings. The latching assembly 56 comprises, additionally, a latching-lever member 57, the details of which are more clearly set forth in FIGS. 21 and 22 of the drawings. The latch-stop member 55 (FIG. 12) has pinned, as at 59, to its outer extremity one end of a spring-retainer rod-assembly 61, the configuration of which is more clearly apparent from an inspection of FIGS. 26 and 27** of the drawings.

Fixedly secured in an upstanding fashion from the base rotatable spindle-support 46 is a stop lug 63, more clearly illustrated in FIG. 14 of the drawings. It will be noted that FIG. 13 is a plan view of the lower rotatable base spindle-support 46, and FIG. 14 is a side-elevational view of the same, illustrating more clearly the upstanding relationship of the stop lug 63.

With further reference to FIGS. 11 and 12, it will be observed that there is provided an electrical solenoide 65 having a plunger 66 associated therewith, which, when the solenoid 65 is electrically energized, as described hereinafter, effects clockwise rotation of a trigger-assembly 68 (FIG. 19) the latter being pivotally supported at 69 to the base-assembly 46. As shown in FIGS. 11 and 12, the trigger-assembly 68 has a latching arm **68*a* (FIG. 19), which latches a roller-assembly 70 to the latter being pivotally secured, as at 71, to the lower portion of the rotatable latch lever-assembly, generally designated by the reference numeral 57 (FIG. 21), and pivotally supported at 58 to a support pin 62 (FIG. 14) affixed to, and rotatable with the lower support base-assembly 46. Thus, release by the trigger-assembly 68 will effect clockwise releasing rotation of the lever-latch assembly 57, thereby unlatching the latch member 55, the latter being affixed to and rotatable with the upper sleeve portion of 50*b* of the upper rotatable cover-casting 50. The battery of compression springs 71, 72 will expand until the adjustable nut 73 engages the stop block 63, the latter being a welded portion of the lower-base-assembly 46** as previously described. This relative rotative motion is approximately 8°–12°, which relative motion is adjustable, as desired.

It will be observed that the latch 55 (FIG. 28) is fixedly secured to a laterally-extending integral supporting portion 60 of the sleeve portion **50*b* of the upper rotatable cover-casting 50, so that the latch 55 rotates together with the upper rotatable cover-casting 50, and consequently with the upper rotatable insulating column 4 under the biasing action exerted by the battery of heavy compression springs 71, 72.**

Additonally provided within the upper cover-casting 50 is a resistor 75 for heating purposes. In other words, it is desirable to prevent condensation of moisture within the space 77 provided within the upper cover-casting 50, which is a relatively enclosed confined space. If such condensation of moisture were allowed to occur, this would possibly provide corrosion and deterioration of the relatively movable parts dispensed therewithin and more importantly keeping dry and so preventing deterioration of electrical insulation of such parts as the tripping solenoid 65 and other electrical parts. Thus, the resistor 75 provides the $I^2R$ heating losses to provide the requisite heat required to prevent condensation occuring within the enclosed volume 77 within the upper cover-casting 50.

Additionally provided within the upper cover-casting 50 is a latch-check switch 79 (FIG. 10) assuming the form of a microswitch, which is actuated by a portion **68*b* (FIG. 20) of the trigger-assembly 68, and prevents energization of the motor mechanism 9 unless the latch assemblies have been reset at the end of the closing operation. In other words, it is impossible to energize the motor 80 unless the latch-check switch 79 is actuated by a resetting of the latch structures 56.**

Also located within the enclosed volume 77 of the upper rotatable cover-casting 50, and fixedly attached to the base-assembly 46, is a terminal block 82, which is accessible through an opening 83 provided in the rotatable cover-casting 50. A cover-plate 85 (FIG. 23) is secured by mounting screws 87 over the upper cover-casting 50 to cover the inspection opening 83 during normal use of the equipment 1.

It will be observed that an "O"-ring 89 (FIG. 10) is provided in an annular recess 90 provided at the outer periphery of the base-assembly 46 to prevent dust entering the enclosed volume 77. Additionally, a nut 92, cooperating with a washer 93, and a spacer 94 maintains a pair of O-rings 95 in a recess portion 96 above the needle bearings 53 to again prevent the entrance of contamination or dirt into the small space 91 between the sleeve portion **50*a* of the upper cover-casting 50 and the shaft 48, in which, of course, is welded at 49 to a part of the lower rotatable base assembly 46** and rotates therewith.

Figure 2:
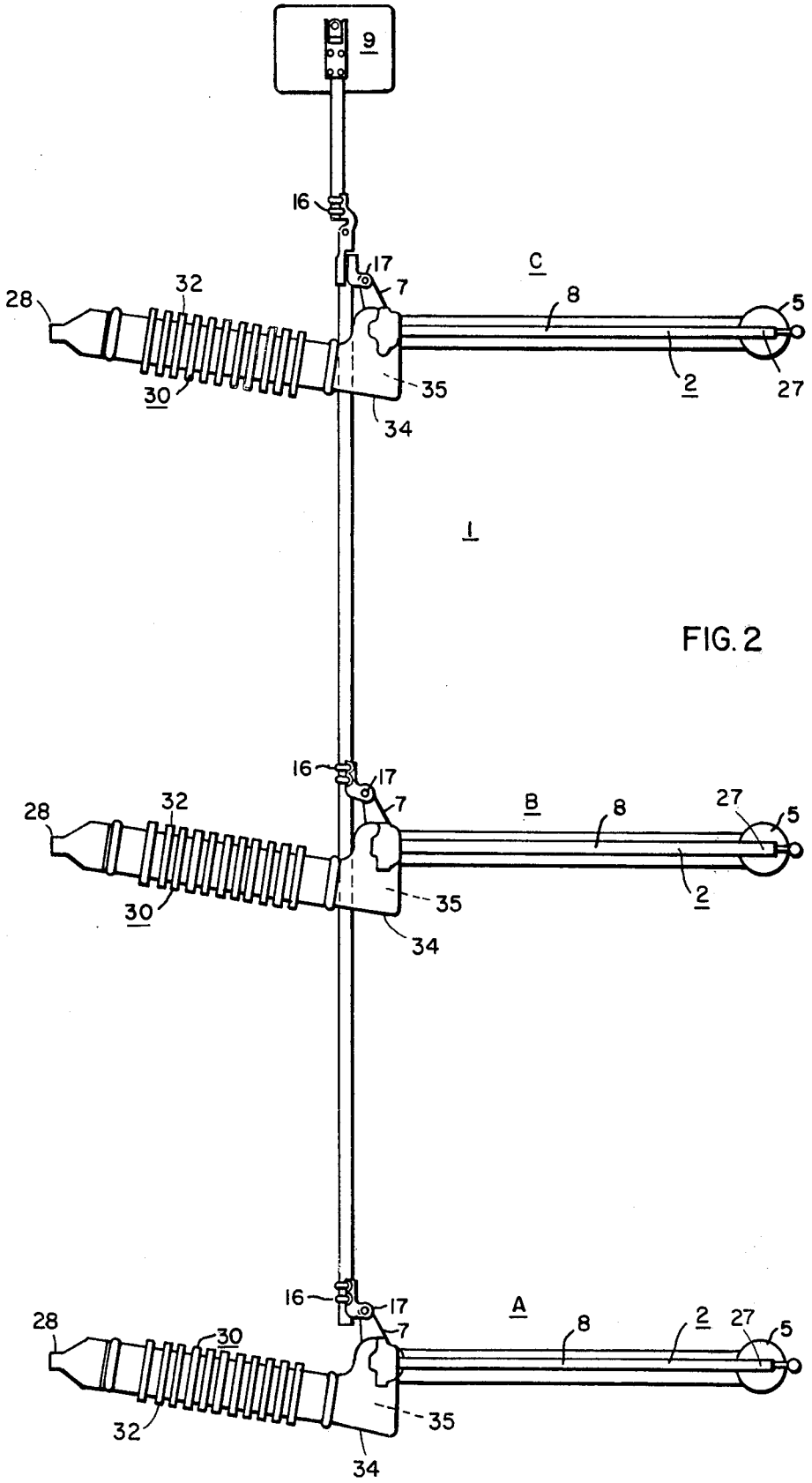
FIG. 2 is a top plan view of the three-phase circuit-interrupting assemblage of FIG. 1, looking downwardly upon the three pole-units, again the disconnecting contact-blade and the mechanically-interconnecting linkage being illustrated in the electrically-closed-circuit position.

As shown in FIGS. 2 and 5, the circuit-interrupter 1, is in the closed-circuit position. To effect a tripping operation, the tripping solenoid 65 is energized at the same time as the motor "M" disposed in the mechanism housing 9. As set forth hereinbefore, the energization of the tripping solenoid 65 (FIG. 56) effects an immediate, very-fast, relative rotative motion of substantially 8°–12° between the upper rotative cover-casting 50, the latter being fixedly secured to the upper insulating rotative driving column 4, and the lower rotatable base-assembly 46, which is, of course, linked to the mechanical linkage 6, 15 extending from the motor M in the mechanism 9 (FIG. 1). This extremely-fast relative rotative motion is desirable to effect a very fast tripping operation of the circuit-interrupter 1 to enable a fast opening operation to occur at the contacts 31 within the interrupter unit 30.

Following the take-up of the lost-motion of 8°–12°, the two members 46 and 50 are then rotatable together as a unitary assembly, and continued clockwise rotative opening motion of this assembly, as viewed in FIG. 11, effects a normal openings operation of the disconnecting switchblade 8. Initially, there is an axial rotation of the switchblade 8 to free any ice formed between the contacts **8*a* and 11, (FIG. 4 and a subsequent rotation of the crank-arm 40 (FIG. 37) will effect an upward swinging, visible opening motion of the disconnecting switchblade 8 to the position 37, as shown in FIG. 4. At the extreme end of the opening operation, an abutment 23 (FIG. 11), provided externally of the upper rotatable cover-casting 50, comes into engagement with a stationary abutment 29 provided on the switch support, and causes the upper cover-casting 50 to stop. However, continued relative motion of the lower base-assembly 46 provides a relative 12°–15° further rotation to effect a recharging of the compression springs 71, 72, and a relatching of the latch assemblies 56 within the upper cover-casting 50. This action occurs at the end of the opening operation of the breaker 1. Following this resetting action of the latch assemblies 56, and also following an actuation of the latch-check switch "LCS", the interrupter 1** is in the fully-open-circuit position, and is in readiness for a stripping operation, following a subsequent closing operation.

CLOSING OPERATION

During the closing operation, the lower base-assembly 46 is rotated in a counterclockwise direction, as viewed in FIG. 11, and carries with it the upper cover-casting 50, the two being latched together as described hereinbefore above. The operation of the motor-operated mechanism 9 effects a counterclockwise rotation of the unitary structure 4, which is now latched together, to first effect a closure of the disconnecting switch 8, and a subsequent closing of the contacts 31 within the interrupter 30.

THE CIRCUIT INTERRUPTER 30

With reference to FIG. 6 of the drawings, it will be observed that the separable contact structure 31 comprises a spring-biased said stationary contact 150 and a movable tubular contact structure 151, which carries an operating cylinder 153 over a relatively stationary piston structure 155. In addition, the movable tubular contact 151 carries an orifice structure 157 having a corrugated opening 159 therethrough, through which gas 152, such as $SF_6$ gas, for example, is forced during the opening gas-moving motion of the operating cylinder 153 over the stationary piston structure 155 to thus force the gas to flow in the direction indicated by the arrows 161 in FIG. 6.

Generally, the interrupting assemblage 30 includes a longitudinally-extending casing 32 of insulating material having sealed to the ends thereof metallic end-cap structures 163, 164. The left-hand metallic end-cap structure 163 is electrically connected to the left-hand load-terminal 28 of the switch structure 1. The right-hand metallic end-cap structure 164 has an opening 167 extending therethrough, which accommodates a metallic bellows 170 and a metallic operating rod 173. One end of the metallic bellows 170 is sealed to the inner face of the opening 167 of the metallic end-cap structure 164. The other, or left-hand end of the metallic bellows 170 is secured in sealing relationship to the movable metallic operating rod 173, which extends into the mechanism compartment 175, and is actuated by the operating mechanism 35, constituting a portion of the present invention.

In the closed-circuit position of the device, not shown, the lazy-tong linkage mechanism 177 is somewhat extended, and forces the movable tubular contact 151 into closed contacting engagement with the stationary tubular contact 150, and somewhat compressing the contact-compression spring 179. Relatively stationary contact figures 181 slide upon the supporting cylinder 183, which carries the relatively stationary contact 150 at its right-hand end in the manner illustrated in FIG. 6 of the drawings.

A support plate 185 is fixedly supported by means not shown from the left-hand metallic end-cap structure 163, and the contact-compression spring 179 seats thereon. The right-hand end of the contact compression spring 179 seats upon a movable spring seat 186, which is affixed to a plurality of spring-rods 188, which are capable of sliding through openings 189 provided in the stationary spring seat 185.

As will be obvious from an inspection of the interrupter 30 of FIG. 6, extension of the lazy-tong linkage 177 brings the tubular contacts 150, 151 into closed contacting engagement to close the electrical circuit through the device 30, whereas retraction of the lazy-tong linkage 177, as caused by rightward movement of the operating rod 173 driven from the mechanism 35, will effect opening of the tubular contact structure 150, 151 with concomitant piston-driving gas-flow 152 action through the tubular orifice 157 to effect extinction of the arc 190, which is established between the contacts.

Although FIG. 6 shows the fully-open-circuit position of the tubular contact structure 31, nevertheless for purposes of clarity, the position of the arc 190 has been indicated to show that it is acted upon by the gas flow forced in the direction of the arrows 161 by the movable operating cylinder 153 sliding longitudinally over the stationary piston structure 155.

OPERATING MECHANISM

The improved operating mechanism 35 provided for the circuit-interrupter 30 includes a latched collapsible toggle-linkage 200, in which is moved laterally by a closing-spring energy-storage means 203 to close the separable contacts 31 within the circuit-interrupting unit 30. This operating mechanism 35, disposed at the upper end of the rotatable column structure 4, is described and claimed in U.S. patent applications Ser. No. 469,931 and Ser. No. 555,212 by Russell E. Frink, et al, and assigned to the assignee of the instant patent application. Preferably, an energy-strorage means is provided, such as a closing-compression-spring means 203, for example, to effect such lateral closing movement of the aforesaid latched collapsible toggle-linkage 200 to thereby close the separable contacts 31 within the interrupting unit 30. In the improved mechanism 35 provided for the interrupter 30, the energy-storage means 203 is actuated by the closing rotative charging movement of the power-device employed to effect operation of the switch structure 30.

Improved means, to be described subsequently, are provided for effecting a tripping opening operation of the switching device 30, including a tripping, or a releasing of certain first latching means 125, which will be operated upon by any slight opening rotative movement of the operating mechanism 35 for the improved circuit-interrupter 30.

In further accordance with the improved operating mechanism 35 provided for the interrupter 30 and for a subsequent opening of the disconnecting contact-blade 8, there is provided an energy-storage means, such as suitable closing compression-spring means 203, which translates closing rotative driving movement of the central insulator column 4 to effect charging of such an energy-storage means 203 to increase the energy content stored therein. Upon a suitable point in time during the closing operation, suitable second releasing means 209 are actuated to thereby effect release of the energy-storage means 203, to thereby cause a lateral contact-closing movement of the latched toggle-linkage 200, which thereby effects closing of the separable contact structure 31 within the serially-related interrupting unit 30, against the opposition afforded by an opening accelerating spring-means 210. The opening accelerating spring-means 210 is, of course, of weaker construction, and affords less of a biasing action, than the aforesaid mentioned energy-storage means 203 constituted by the closing-spring assemblage 121, 122. The coordination provided by the operating mechanism 35 between the swinging opening and closing movements of the disconnecting switchblade 8 is such as to effect closing of the swinging disconnecting switchblade 8 prior to a subsequent closing of the separable contact structure 31 disposed within the serially-related interrupting unit 30.

It is to be furthermore noted that during the opening operation, the contact structure 31 within the interrupting unit 30 is opened prior to the subsequent opening of the swinging disconnecting switchblade 8, which effects a visible isolation gap inserted into the controlled electrical circuit. As a result, all deleterious arcing occurs at the contacts 31 within the interrupting unit 30, which is in and of itself fully capable of effecting extinction of such arcing 190, rather than at the exposed separable disconnecting contacts **8*a*, 11 of the swinging disconnecting switchblade 8, the function of which is restricted to an isolating purpose, or function only. Conversely, during closing operation all deleterious effects of prestriking electrical arc occur within the chamber of the interrupting unit 30, while the disconnecting blade 8** is already in a closed position.

With reference to FIG. 33 of the drawings, it will be observed that the mechanism 35 is bolted to the right-hand metallic end-plate 164 of the interrupter 30, as shown more clearly in FIG. 33 of the drawings. The mechanism construction 35 is shown in more detail in FIGS. 29, 30 and 32 of the drawings.

FIG. 29 illustrates the operating mechanism 35 for the interrupter 30 in the fully open-circuit position with the linkage parts reset. FIG. 30 illustrates the disposition of the linkage parts of the mechanism 35 in the ready-to-close position. FIG. 31 illustrates the position of the mechanism parts 35 in the closed position of the interrupter 30 and disconnecting switch 2, and ready to trip open upon a very slight counterclockwise rotation of the driving insulator column 4, as more clearly described hereinafter. FIG. 32 illustrates the disposition of the several parts of the mechanism linkage in the tripped position with the interrupter 30 open, the disconnecting switch 2 still remaining closed, and the parts of the first latching mechanism 125 not being reset.

Energy for closing the circuit-interrupter contacts 31 within the interrupter casing 30 is supplied by a pair of nested springs 121, 122 (FIG. 42), which are contained between a pair of yoke members 108 and 112. Yoke members 108 is moved upwardly as the drive shaft 38 is rotated in a clockwise direction with reference being directed to FIG. 29. The operating drive shaft 38 is, of course, secured to the upper end of the rotatable operating driving insulator column 4 of FIG. 5, and is rotated upon rotation of the insulator column 4. The upper yoke 112 carries lateral-disposed trunnions 115, about which the toggle links 113 and 114 are pivoted. The guide link 120 (FIG. 51) rotates about a fixed pivot pin 123 (FIG. 33), which is fixedly anchored to the internal side-walls **34*a* of the mechanism housing 34, which guide links 120 (two in number) restricts the rotative motion of the trunnions 115 to an arc about the fixed pivot pin 123**.

The toggle link 113, together with an additional interconnecting toggle link 114, are joined at a knee-pin 126 (FIG. 33) to form the collapsible toggle-linkage 200, the collapse of which is restricted by a control link 210, which is also connected to the latch assembly 125 of the first releasing means. The opposite end of the toggle link 113 is connected to the operating shaft 173 of the circuit-interrupter 30 by means of a spring plate 174. This is more clearly shown in FIG. 33 of the drawings.

With reference being directed specifically to FIGS. 41 and 42 of the drawings, it will be apparent that there is provided a lower spring-seat assembly 108, comprising a cup-shaped spring-plate yoke 109 having an upwardly-extending supporting flange portion 109*a*, which is threadedly secured to a spring guide stud 110, which slidably passes through a spring guide-sleeve 111, the latter being affixed, as by welding, to an upper spring-seat yoke assembly, designated by the reference numeral 112, which has a pair of downwardly-extending leg portions 112*a*. As shown in FIG. 42, the downwardly-extending leg portions 112*a* have lateral-extending pivot, or trunnion pins 115 extending outwardly therefrom, the purpose for which will become more apparent hereinafter. It will be observed moreover that threadedly secured to the top of the guide stud 110 is an adjustable nut 117, which is retained in its adjusted position by a laterally-extending locking pin 119. Thus, in the positions shown in FIGS. 41 and 42, the battery of biasing compression springs 121 and 122 are compressed in their pre-charged state, and are maintained in a pre-charged condition by the guide stud 110 and the upper adjustable nut 117 threaded thereon, which is disposed above and in abutment with the upper U-shaped spring-plate yoke member 112.

A pair of hook-links 127 constituting a part of a second releasing means 209 are pivoted directly upon the drive shaft 38, and are biased in a counterclockwise direction, as viewed in FIG. 31 of the drawings, by a spring 129. In more detail, the two hook-links 127 are connected together by a T-shaped plate 127*a*, having a tongue portion 127*b* biased by the spring 129. These two hook-links 127 cooperate with the lateral trunnions 115 to restrict the releasing motion of the upper yoke member 112, while the closing compression springs 121, 122 are being compressed by the clockwise driving rotation of the operating shaft 38. Toward the end of the clockwise closing travel of the lower yoke 108, release pins 118 moving with the lower yoke member 108, contact the hook-links 127 moving them clockwise and disengaging them from the lateral trunnions 115 permitting thereby the closing springs 121, 122 to thereby expand, straightening the toggle linkage 113, 114 and close the interrupter contacts 31 at high speed within the interrupter casing 32.

It will be observed that in FIG. 31, which shows the interrupter 30 closed, that a pawl 134 (FIG. 48) moves on a crankplate 199 with the drive shaft 38, and that this release pawl 134 is in contact with a ratchet 131 carried by a trip-trigger 131 (FIG. 54).

In more detail, with reference to FIGS. 32, 38, 53, and 54, which more clearly show in detail the rotatable tripping latch 131, it will be noted that, generally, there is provided a stamped U-shaped channel member 131 having side leg portions 131*a* and 131*b*, one of the leg portions 131*b* having an end portion with a serrated end surface "S", as shown more clearly in FIG. 54 of the drawings.

As more fully described hereinafter, the serrated latching surface S, when reversed by reverse counterclockwise rotation of the tripping pawl 134, will effect release of a roller 138 (FIG. 53) from the position illustrated in FIGS. 30 and 31, to the released position, as illustrated in the tripped position of the interrupting unit 30, as shown in FIG. 32 of the drawings. As previously described, the offcenter tripping shaft assembly 143 is more clearly illustrated in FIGS. 30, 31, 49, and 50 of the drawings. This assembly, as shown in more detail in FIGS. 49 and 50, has end mounting pivot pins 145 and 146, which fit into upper and lower bearing holes provided in the top and bottom side-wall plate portions 34*b* of the mechanism-housing casting 34.

A very small counterclockwise rotation of the operating drive shaft 38 will, accordingly, release the latch roller 138 of the first releasing means, permitting thereby the toggle-linkage 200 to fold, or collapse, and the interrupter contacts 31 to be driven open by the opening accelerating springs 210, again at high speed. During this time, of course, the disconnecting switch contacts 8, 11 are closed, so that there is no arcing whatsoever occurring at the disconnecting switch contacts 8, 11 (FIG. 4). Additional counterclockwise opening rotative movement of the operating drive shaft 38 resets the links 113, 114 to the position, as shown more clearly in FIG. 30 and effects opening swinging motion of the disconnecting switchblade 8.

As mentioned, it will be observed that the improved interrupter operating mechanism 35 of the present invention includes a latched laterally-movable collapsible toggle-linkage, generally designated by the reference numeral 200, which is laterally movable to the left, as viewed in FIG. 30, to effect the closing of the contact structure 31 within the interrupting unit 30. In more detail, the operating rod 173 extends through the aperture 167 in the end-plate portion 164 of the mechanism housing 34, as illustrated more clearly in FIG. 33 of the drawings. This operating rod 173 is extended through a hollow piston rod 180, the left-hand end of which is fixedly secured, as by welding, for example, to a movable piston 182 movable within the dashpot structure 184 to cushion the end of the opening operation of the contacts 31. It will be noted that the dashpot structure 184 is formed as an integral part of the mechanism-housing end-plate 34*c*, as is illustrated more clearly in FIG. 33 of the drawings. The piston structure 182 has the hollow stem portion 180 thereof, movable through a sealed opening 171, and is secured to the spring-plate 174 by a nut 176, which is threaded onto the outer threads 178 of the hollow piston stem 180. Interposed between the inner side wall 34*c* of the mechanism housing 34 and the movable spring-plate 174 is a battery of opening accelerating compression springs 210, in this particular instance comprising two in number. As shown in FIG. 33 these opening accelerating compression springs 210 seat at their left-hand ends against the inner wall 34*c* of the mechanism housing 34, and at their right-hand ends against the movable spring-plate 174. In addition, the spring-plate 174 has a pair of journals 168, forming pivot-bearing openings, welded to the right-hand side of the movable spring-plate 174. The bearing openings 168 provide bearings for the pair of movable toggle-links 113, which are pivotally connected to the two knee-pins 126 to a second set of toggle-links 114, the right-hand ends of which are pivotally secured at 115 to the downwardly-extending legs 112*a* of an upper spring-support yoke plate 112, constituting a part of the closing-energy storage structure, the latter being generally designated by the reference numberal 203.

FIG. 31 illustrates the longitudinally-movable toggle-linkage 200 in its latched underset condition, the knee-pins 126 being maintained in their straightened condition by the downwardly extending movable control latch-levers 210 (FIG. 55), the latter being pivotally connected, as at 214, to latching toggle plate members 100, 215 of an off-center trip-shaft assembly 143 (FIGS. 49, 50). This assembly has an offset portion 217, which is normally maintained in latching engagement by the roller 138 (FIG. 31). The roller 138 is pivotally supported between the side-arms 131*a*, 131*b* of the pivotally-mounted latch 131, as illustrated more clearly in FIGS. 53 and 54 of the drawings. As shown in FIGS. 30 and 31, normally the latch roller 138 latches into the underset portion 217 of the cam plate 215, and maintains the collapsible toggle structure 200 in its straightened underset condition as shown in FIG. 31.

It will be noted that there is an utilization of the energy-storage device 203 to effect a leftward closing quick movement of the contact operating rod 173 against the opening spring pressure afforded by the battery of opening accelerating compression springs 210. As mentioned hereinbefore, the opening springs 210 are, of course, weaker than the closing-spring assemblage 121, 122. This opening biasing movement 210 is achieved and obtained by the rotative closing movement of the operating post indicator 4. In more detail, the upper end of the post insulator 4 has secured thereto the flange 208 (FIG. 39) of the drive-shaft 38 to which is keyed by pins 38*a* the crank-arm sleeve 195 (FIG. 43).

The drive shaft 38 has an extension 38*b* (FIG. 38) to which is affixed a crank-arm 40 (FIG. 37) which is rotatable during both the opening and closing operations of the disconnecting-switch device 2 of the present invention.

In more detail, the upwardly-extending operating shaft 38 has the sleeve 195 (FIG. 43, 44) pinned thereto, as by key pins 38*a*. The sleeve 195 (FIG. 43) is, consequently, rotatable with and movable with the operating drive shaft 38. In addition, the sleeve 195 carries a pair of spaced operating crank arms 192 and 199, which are pivotally connected, as at 118, to the lower spring-support yoke member 108, which cooperates with the aforesaid upper spring-support yoke member 112 to house the battery of energy-storage closing-springs 121, 122, which are charged during the closing operation of the disconnecting switch 2 of the present invention in a manner more fully described hereinafter.

It will be observed that there is provided a vertically-spaced pair of guide links 120 (FIG. 33), which are pivoted about the stationary pivot supports 123 disposed at the upper and lower sides of the mechanism housing 34. FIG. 33 more clearly shows the stationary pivot-supports 123 on the inner side walls 34*a* of the mechanism housing 34 provided for the fixed rotative motion of the two guide-links 120. Accordingly, the two guide links 120 restrict the arcuate travel of the trunnion pivot-pins 115 to an arc about the center of the stationary pivot-points 123. Also pivoted about the knee-pins 126 are the cooperable pair of latching toggle-links 210, which have slightly elongated holes at their lower ends. Cooperating with these holes are pins 214 provided in the arms 213, 215. The arms 213, 215 are welded to the shaft 220, which is journaled in the upper and lower bearings 104, 105 (FIG. 34). One of the arms 215 has a stepped cam surface 217 formed integrally therewith, as shown more clearly in FIG. 49.

The tripping trigger assembly 131 is biased in a counterclockwise direction by a spring 221 (FIG. 31) against the latch notch 217. The latch 131 is pivoted around a pin 219 (FIG. 31), which is held by the mechanism housing side wall 34*d* (FIG. 36). This latch carries the roller 138 which cooperates with the step 217 provided in the latch-cam 215. The serrated edge S of the latch 131 cooperates with the pawl 134 which is attached to one of the crank-arms 199. The hook members 127 are pivoted around the drive shaft 38 and are biased in a counterclockwise direction by spring 219, as more clearly illustrated in FIG. 31.

CLOSING OPERATION OF THE INTERRUPTER MECHANISM 35

FIG. 29 shows the interrupter operating mechanism 35 with the disconnecting switch contacts 8, 11 and the interrupter contacts 31 both open. The closing operation is performed by rotating the vertically-disposed operating shaft 38 in a clockwise direction, as viewed in FIG. 29. The two latch hooks 127 (FIG. 46) cooperate with the pins 115 to retain the latched position of the upper spring-seat yoke 112 while the two crank-arms 192, 199 rotate clockwise to drive the lower U-shaped spring-seat yoke-member 108 upwardly to compress the battery of closing compression springs 121 and 122. Approximately 10° before the final position of the operating drive shaft 38, the release pins 118 moving with lower yoke member 108 rotate the latching hooks 127 in a clockwise direction against their spring bias, which releases or frees the pins 115 and permits the closing springs 121, 122 to expand upwardly, and force the pins 115 to rotate in an arc about the fixed pivot pins 123. This applies a compressive closing force to the toggle-links 113, 114, but the pins 115 are restricted in their arcuate motion by the guide-links 120 to an arc about the fixed pins 123. Consequently, the motion of the knee-pins 126 is mostly in a leftward horizontal closing direction, and thus knee pin 126 drives the toggle-link 113, 114 horizontally to the left, as viewed in FIGS. 29–32, to thereby compress the opening accelerating springs 210, and also move the operating rod 173 to the left, which closes the separable contacts 150, 151 within the interrupting-unit 30.

Rotation of the operating drive shaft 38 to close the interrupter 30 has also rotated upper crank hinge-arm 40 to thereby close the disconnecting switch 2, and the disconnecting switchblade 8 is closed before the latch hook-members 127 are released to thereby close the interrupter contacts 150, 151 within the interrupter-unit 30. The position of the operating mechanism 35 with both the disconnecting switch-contacts 8, 11 and the interrupter contacts 31 closed is illustrated in FIG. 31.

It will be observed that during the latter part of the closing operation, the pawl 134 moving with crank-arm 199 has ratcheted along the serrated edge S of the latch release member 131. Consequently, a very small tripping rotation travel of the operating drive shaft 38 in a counterclosewise direction as viewed in FIG. 31 will impart a clockwise rotation to the latch 131 about stationary pivot pin 219. The cam member 215 is biased in a counterclockwise direction by the accelerating springs 210 working against the toggle 200 between the toggle links 113 and 114. When the latch-roller 138 moves out of latching contact with the step 217 provided in the latch cam 215, the arms 213, 215 rotate in a counterclockwise direction as viewed in FIG. 31 permitting the toggle 200 between links 113 and 114 to collapse. Accelerating opening springs 210 expand, which pulls the contact operating rod 173 of the interrupter 30 to the right, and opens the contacts 150, 151 within the interrupter-unit 30. This motion is arrested at the end of the opening stroke by the dashpot piston 182, which operates within the dashpot cylinder 184, which is a part of the mechanism housing 34c. Opening of the interrupter 30 is thus accomplished with a very small rotation of the operating drive shaft 38.

The lost-motion coupling between the operating drive shaft 38 and the disconnecting switch crank operator 40 permits this rotation before starting to open the disconnecting switch 2. This feature thus reduces the tripping time as well as applies a sharp impact to the initial disconnecting switch opening, which is, of course advantageous if the switch contacts 8, 11 are coated with ice. Also the ratcheting feature "S" of the latch assembly 131 removes the criticality of adjustment of the switch-closed position.

With the operating mechanism 35 in the position illustrated in FIG. 32, further counterclockwise rotation of the operating shaft 38 opens the disconnecting switch 2, and restores the operating mechanism 35 to the reset position illustrated in FIG. 30. Power of the switch operation is derived from rotation of the driving insulator column 4 (FIG. 4), which is rotated by the motor-powered operator 9.

It will be observed that power for both opening and closing the circuit interrupter 30 is derived from the closing operation of the disconnecting switch 2. This is advantageous inasmuch as such switches 2 are often required to open when encased in a layer of ice during winter operation. This scheme of operation leaves all of the energy of the operator 9 free for ice breaking duty during opening of the switch 2, and stores energy for interrupter 30 opening operation during switch-closing action when the switchblade 8 is moving freely through the air.

It should also be observed that the sequences accomplished by this interrupter operating mechanism 35 confine all arcing on both opening and closing operations to the inside of the interrupter casing 32, and since the device is able to make currents of full-fault magnitude, this represents a real improvement over any device now on the market with the exception of the clostly power circuit-breaker.

Improved first releasing means 125 for effecting a tripping operation of the device is provided including a latching means 131, 143, which will be operated upon any slight counterclockwise rotative movement of the operating mechanism 35 for the switch. In addition, unique adjusting means are provided with power for both opening and closing circuit interrupter operations being derived from the closing operation of the disconnecting switch 2.

ELECTRICAL CIRCUIT FOR THE CIRCUIT INTERRUPTER

Reference is directed to the electrical circuit in FIG. 56 in which the rectangles 130 indicate the component parts which are disposed within the upper cover-castings 50. It will be noted that the energizing circuits 132 and 133 consists of both "plus" and "minus" leads connected to a direct-current energizing source 135, not shown. The circuits in the shunt-trip housings 50 are, as mentioned, provided within the rectangles 130, and, as shown, are provided for each pole-unit "A", "B", and "C". The electrical circuit, illustrated in FIG. 56, shows the device 1 in the deenergized position, and the center insulator driving columns 4 have been rotated far enough to the open-circuit position to set the tripping springs and the tripping latches.

This closes the three micro-switches 137, which act as latch-checking switches (LCS). If the "close" push-button 140 is now closed, relay coil 141 is energized, which closes contacts 142, which energizes the motor "M", which closes the disconnecting switch 2 and the circuit-interrupter 30. Final closing of the disconnecting switch 2 and the circuit-interrupter 30 closes the "*aa*" contact, which makes up the tripping circuit, and opens the "*b*" contacts, which shut off the motor M and the relay coil 142. If the trip-button 144 is now pushed, the trip coils 65 of the accelerating tripping devices 42 are energized, which releases the tripping springs 71, 72 in the three columns 4 to rotate the several insulator driving columns 4 quickly through a sufficient angle, of about 8°, to thereby release the three latch-in mechanisms 125, thereby permitting all three circuit-interrupters 30 to open. This also opens the "*aa*" contact which cuts off the trip-coil current.

Another section of the control circuit (not shown), which does not comprise a part of this invention, causes the motor "M" to rotate in the opposite direction to open the disconnecting switches 2, close the "*b*" contacts and reset the latch-check switches "LCS". Also, there is an electrical heater 128 provided within each housing 50 to prevent the condensation of moisture therein. These heaters 128 are across the energizing supply circuit 132, 133 at all times.

TYPICAL RATINGS OF INTERRUPTING DEVICES

The ratings of interrupting devices 1 incorporating the improved inventions of the present application are as follows:

| | |
|---|---|
| Rated maximum voltages | 121, 145 and 169 kV |
| Rated continuous current | 1200 A. |
| Rated symmetrical interrupting current | 10,000 A. |
| Rated TRV capability at max. int. current | 1.7 kV per $\mu$ S |
| Momentary current, rms asymmetrical | 61,000 A. |
| 4-second current, rms symmetrical | 40,000 A. |
| Closing current, rms asymmetrical. | 30,000 A. |
| Interrupting time (60 Hz basis) | 5 Cycles |
| Contact opening speed 15.5 ft. per sec. | (4.7 m per sec.) |
| Contact closing speed 14 ft. per sec. | (4.3 m per sec.) |
| Total operating time (open or close) | 4 sec. |
| Control voltages | 48V. dc, 125V. dc and 250V. dc |

ALTERNATE ACCELERATING TRIPPING EMBODIMENT

With reference being directed particularly to FIG. 58 of the drawings, it will be observed that there is provided in alternate accelerating tripping device, generally designated by the reference numeral 300, and comprising a flanged tubular metallic driving member 302 extending through ball-bearings 304, 305 operating in cups 307, 308 welded, for example, within the stationary base 310. Connection to the motor-operator 9 is made by a lever *7a,* which bolts to the flange portion 302. Keyed to the bottom end of the driving tube 302 is a forged member 312, which acts as a ball-race and also fulfills the purpose of the base-assembly 46 of FIG. 7. Member 312 is further secured to the member 302 by a nut 314. Extending through the member 302 is a shaft 316, which has an attached upper flange 317, which bolts to the upstanding post-insulator 4 (not shown) and a crank-member 320 is keyed to its lower end. Freedom of rotation between members 302 and 316 is provided by the ball-bearings 321, 322, which are adjusted by the nut 323. Shunt trip 42*a,* spring, latches, etc., similar to those previously described in FIGS. 7 and 10, are located in the space, generally designated by the reference numeral "X".

A cover box 324 with access cover 325, is welded to the base 310. A pipe conduit 327 electrically connects the three accelerating tripping devices 300 of the three pole-units A, B and C.

The advantage of this alternate arrangement 300 is a lower profile, and elimination of the flexible conduit, which might be subject to damage over long operational life. The principal disadvantage of this alternate arrangement 300, as set forth in FIG. 58, is that different switch bases are required depending on whether or not an accelerated tripping device 42A is employed.

From the foregoing description it will be apparent that there has been provided an improved accelerating tripping device 42, which reduces the interrupting time tremendously over that which would occur if the more relatively slowly-moving linkage, extending from the motor M to the upstanding rotating insulating driving column 4, were used. By utilizing the optional accelerating tripping device 42 of the present invention, the interrupting time, on a 60 Hz basis, is reduced to 5 cycles. Thus, the insulator driving column 4 very rapidly rotates, under the quick impulse-biasing action exerted by the two compression springs 71, 72 independently of the more slowly-moving lower base spindle support 46, the latter, of course, being linked mechanically to the motor-operated mechanism "M" disposed within mechanism housing 9 of FIG. 1.

From the foregoing description, it will be apparent that there has been provided an improved, quick-acting, tripping accelerator device 42, which effects a practically instantaneous rotative tripping motion of the upper cover-casting 50, and hence the supporting operating column structure 4 to thereby trip the circuit-interrupter 30 open within a very short time, say of the order of 5 cycles.

The structure is such that the device may be used optionally, in conjunction with a load-break switch, either having a disconnecting switchblade structure 2, in series therewith, or not, as set forth in FIG. 57.

FIG. 57 illustrates an application of the improved accelerating tripping device 42 of the present invention, together with the operating mechanism 35 for the circuit-interrupting unit 30 in the absence of a disconnecting-switch structure 2. It is to be noted that line terminals $L_1$, $L_2$ are provided at the left-hand end metallic plate 163 of the interrupter unit 30, and also at the right-hand end of the mechanism housing 34, as shown in FIG. 57. The open-circuit gap distance between the opened contacts 150, 151 (FIG. 6) within the interrupter unit 30 may be increased slightly to be able to withstand the fully-open circuit line-voltage, even in the absence of the use of a disconnecting switchblade 8. In other words, the device of FIG. 57 may have its dimensions slightly enlarged to eliminate the necessity of utilizing a serially-related disconnecting switchblade 8, as was the case in FIG. 4 of the drawings.

The operating mechanism 35 of FIG. 57 is identical to that heretofore described; consequently, a further description thereof appears unnecessary. In addition, the accelerating tripping device 42, disposed at the lower end of the driving insulator column 4 of FIG. 57, is identical to that heretofore described in connection with FIGS. 10, 11 and 12; consequently, a further description of the accelerating device 42 appears unnecessary. The important fact to notice is that in the device of FIG. 57, a disconnecting-switch structure 2 is not utilized, but nevertheless the improved advantageous features of the accelerating device 42 and the interrupter mechanism 35 may, nevertheless, be utilized to advantage.

The improved operating mechanism 35 of the present invention may be employed with a medium fault-break switch, or a load-break switch, alternatively, or for particular applications, where the utility customer desires to view an open visible condition of the switch structure 2, and therefore a series disconnecting switchblade 8 is deemed desirable, from a safety standpoint, the present novel mechanism 35 is also suitable not only to effect the opening and closing movements of the separable interrupter switch contacts 31, but the improved mechanism 35 may additionally be employed for operation of the opening and closing movements of the disconnecting switchblade of the series-utilized disconnecting switch structure 2.

Thus, the operating mechanism 35 of the present invention may be of universal application for load-break switch operation, medium fault-break switch operation, or utilized for conjoint cooperative action between an interrupter-switch 30 and an electrically series-related disconnected switch structure 2 to provide an open visible break when the device is in the open-circuit position.

Although there have been illustrated and described specific structures, it is to be clearly understood that the same were merely for the purpose of illustration, and that changes and modifications may readily be made therein by those skilled in the art without departing from the spirit and scope of the invention.

What we claim is:

1. In combination, an electrical device including a circuit-interrupter and a serially-related disconnecting switch having a movable switchblade all at high voltage spaced away from ground potential, said circuit-interrupter having one or more separable contacts, operating means at high voltage for operating both the separable contacts and the switchblade contacts in synchronism, whereby the separable contacts open the electrical circuit passing through the device prior to the subsequent separation of the disconnecting switch contacts, only single rotatable insulating column means for supporting said device up in the air above ground potential, a relatively slow-acting operating mechanism disposed at ground potential, said single rotatable insulating column means rotatively transmitting during opening and closing rotative motions from said relatively slow-acting operating mechanism at ground potential to said high-voltage operating means, said separable contacts remaining open in the fully open-circuit position of the electrical device, the operating mechanism at high voltage functioning to close the disconnecting contacts during the closing operation prior to point of time to the subsequent closing of the separable contacts in the high-voltage circuit interrupter, said sole single rotatable insulating column means including two relatively-movable component parts disposed adjacent the base thereof, biasing means for urging relative motion between said two component parts, means latching said two component parts to remove together as a unit while under bias during rotation of the sole rotatable insulator, and tripping means at ground potential for releasing said latching means to permit the biasing means to effect relative motion of said two relatively-movable parts, whereby face-acting rotation of said single sole insulator column occurs and trip-operation of the circuit-interrupter contacts occurs independently of the relative slow motion of the grounded operating mechanism.

2. The combination according to claim 1, wherein the insulating column means provides a rotary motion to effect transmission of motion of the relatively slow-acting operating mechanism at ground potential to the high-voltage operating means for operating the circuit-interrupter and the serially-related disconnecting switch.

3. The combination according to claim 1, wherein the latching means includes a latch-member affixed to and rotatable with one of the component parts, and a tripping trigger-member affixed to and rotatable with the other component part.

4. The combination according to claim 1, wherein the biasing means includes a compression-spring compressed under heavy spring force in the latch condition of the two relatively-movable component parts.

5. The combination according to claim 1, wherein the high-voltage operating means effects a closing of the disconnecting switch contacts during a closing operation of the device prior to the closing of the separable contacts of the circuit-interrupter during such a closing operation.

6. The combination according to claim 1, wherein the tripping means includes an electrically-operated solenoid device disposed at ground potential.

7. The combination according to claim 3, wherein the trigger-member is released by an electrically-energized solenoid device.

8. The combination according to claim 1, wherein the device is supported up in the air by two end stationary insulating column structures, an intervening sole rotatable column member is provided which is rotatable to effect operation of the operating means, and the two component parts are associated with the intervening single rotatable column structure, both of said parts being adapted for rotation.

9. The combination according to claim 1, wherein the high-voltage operating means includes a closing spring structure and an opening spring structure, and the closing operation of the high-voltage operating means effects a charging of the closing spring structure to effect quick-closing operation of the circuit-interrupter contacts.

10. The combination according to claim 9, wherein an opening accelerating spring is charged during the closing of the separable contacts of the circuit-interrupter.

11. the combination according to claim 1, wherein the relatively slow-acting operating mechanism at ground potential includes a motor mechanism, an interconnecting linkage mechanically interconnects the motor mechanism with the sole single insulating column means, and one of the insulating column means includes a rotatable column structure having two rotatable relatively-movable parts, one of said rotatable relatively-movable parts being mechanically linked to said motor mechanism at ground potential, the other relatively movable component part being fixedly secured to the lower end of the single rotatable column structure, and latching means are provided for latching the two relatively-movable rotatable component parts in a latched condition under spring bias.

12. The combination according to claim 1, wherein the circuit-interrupter includes a hermetically-sealed casing structure, the separable contacts are disposed interiorly within said sealed casing structure, and a suitable arc-extinguishing gas is provided interiorlyof said casing structure to assist in arc-interruption.

* * * * *